US009534858B2

(12) United States Patent
Forbes et al.

(10) Patent No.: US 9,534,858 B2
(45) Date of Patent: Jan. 3, 2017

(54) CARTRIDGE AND SYSTEM FOR GENERATING A PROJECTILE WITH A SELECTABLE LAUNCH VELOCITY

(71) Applicant: The Commonwealth of Australia, Edinburgh (AU)

(72) Inventors: Stephen Forbes, Edinburgh (AU); Edmond Almond, Edinburgh (AU); Shaun McCormack, Edinburgh (AU); Jeffery Ackers, Edinburgh (AU); Robert Reichstein, Edinburgh (AU); Michael Chatwin, Edinburgh (AU)

(73) Assignee: The Commonwealth of Australia, Edinburgh, South Australia (AU)

( * ) Notice: Subject to any disclaimer, the term of this patent is extended or adjusted under 35 U.S.C. 154(b) by 211 days.

(21) Appl. No.: 14/351,724

(22) PCT Filed: Oct. 15, 2012

(86) PCT No.: PCT/AU2012/001242
§ 371 (c)(1),
(2) Date: Apr. 14, 2014

(87) PCT Pub. No.: WO2013/053016
PCT Pub. Date: Apr. 18, 2013

(65) Prior Publication Data

US 2015/0159981 A1 Jun. 11, 2015

(30) Foreign Application Priority Data

Oct. 14, 2011 (AU) ..... 2011904179

(51) Int. Cl.
*F41A 1/06* (2006.01)
*F42B 5/08* (2006.01)
(Continued)

(52) U.S. Cl.
CPC ..... *F41A 1/06* (2013.01); *F41A 19/58* (2013.01); *F41A 19/69* (2013.01); *F41C 27/06* (2013.01);
(Continued)

(58) Field of Classification Search
CPC ..... F41A 19/58; F41A 19/69; F41A 1/06; F41A 7/10; F41C 27/06; F41B 11/57; F42B 5/145; F42B 5/02; F42B 5/08; F42B 10/32
See application file for complete search history.

(56) References Cited

U.S. PATENT DOCUMENTS 667,435 A * 2/1901 Friese-Greene et al. . F42B 5/10 102/375
3,142,959 A * 8/1964 Klein ..... F42B 15/36 102/352
(Continued)

FOREIGN PATENT DOCUMENTS

FR 2792399 A1 10/2000
FR 2865799 A1 8/2005
(Continued)

*Primary Examiner* — Benjamin P Lee
(74) *Attorney, Agent, or Firm* — The Webb Law Firm

(57) ABSTRACT

A weapon system includes a cartridge and a fire control apparatus have been developed for generating a projectile with a selectable launch velocity. The cartridge includes multiple primers and propellant chambers which may be individually selected by the fire controller so as to fire the projectile at a selected launch velocity. Additionally after firing the selected primers and propellant charges, the fire controller sends a second firing signal to all remaining primers after a suitable delay. The second firing signal ensures that all remaining propellant is initiated and consumed, thus rendering the cartridge safe to eject. The delay between the first firing signal and the second firing signal is sufficient to allow the projectile to be expelled from the
(Continued)

cartridge so that the launch velocity is not affected by the combustion of the remaining propellant.

17 Claims, 28 Drawing Sheets

(51) Int. Cl.

| | |
|---|---|
| ***F41A 19/58*** | (2006.01) |
| ***F41A 19/69*** | (2006.01) |
| ***F42C 19/08*** | (2006.01) |
| ***F41C 27/06*** | (2006.01) |
| ***F41G 1/473*** | (2006.01) |
| ***F41G 3/06*** | (2006.01) |
| ***F42B 10/32*** | (2006.01) |
| ***F42B 12/02*** | (2006.01) |
| ***F41H 9/10*** | (2006.01) |
| ***F42B 5/145*** | (2006.01) |
| *F42B 5/02* | (2006.01) |

(52) U.S. Cl.

CPC ..... *F41G 1/473* (2013.01); *F41G 3/06* (2013.01); *F41H 9/10* (2013.01); *F42B 5/08* (2013.01); *F42B 5/145* (2013.01); *F42B 10/32* (2013.01); *F42B 12/02* (2013.01); *F42C 19/0834* (2013.01); *F42B 5/02* (2013.01)

(56) References Cited

U.S. PATENT DOCUMENTS

| | | | | |
|---|---|---|---|---|
| 3,283,719 | A | 11/1966 | Grandy | |
| 4,619,202 | A | 10/1986 | Romer et al. | |
| 5,880,397 | A | 3/1999 | Crilly | |
| 6,142,056 | A | 11/2000 | Taleyarkhan | |
| 7,475,636 | B2 | 1/2009 | O'Dwyer et al. | |
| 7,698,849 | B2 | 4/2010 | O'Dwyer et al. | |
| 7,905,178 | B2 * | 3/2011 | Dryer | F41A 1/02 102/202 |
| 9,068,807 | B1 * | 6/2015 | Thomas | F42B 15/10 102/370 |
| 9,200,876 | B1 * | 12/2015 | Thomas | F42B 5/02 |
| 2010/0000438 | A1 * | 1/2010 | Dryer | F41A 1/02 102/443 |
| 2016/0018201 | A1 * | 1/2016 | Hultman | F42B 5/16 102/430 |

FOREIGN PATENT DOCUMENTS

| | | | | |
|---|---|---|---|---|
| WO | 2004070307 | A1 | 8/2004 | |
| WO | WO 2014197079 | A1 * | 12/2014 | F42B 5/02 |

* cited by examiner

CARTRIDGE AND SYSTEM FOR GENERATING A PROJECTILE WITH A SELECTABLE LAUNCH VELOCITY

PRIORITY DOCUMENTS

This application is the United States national phase of International Application No. PCT/AU2012/001242 filed Oct. 15, 2012, and claims priority to Australian Provisional Patent Application No. 2011904179 filed Oct. 14, 2011, the disclosures of which are hereby incorporated in their entirety by reference.

TECHNICAL FIELD

The present invention relates to projectiles. In a particular form the present invention relates to cartridges and systems for generating projectiles with variable launch velocities.

BACKGROUND

Both military and civilian agencies are increasingly being required to provide or restore public order or to act in peace keeping or security roles. Further many modern warfighters are being required to operate in urban environments with large resident civilian populations, whilst being on guard for possible attack by enemy combatants who may be largely indistinguishable from the local population.

To assist such agencies in providing such roles, various non lethal weapons systems and projectiles have been developed. Such systems allow the user to modify an aggressor's intent by striking them at range with a "controlled or measured" amount of kinetic energy, which is delivered to the body by the impact of a "Non Lethal" projectile. Other types of non lethal rounds include those which deliver electrical charges to the target (eg TASER™) or non lethal projectiles such as stunning (eg sound), smoke, or irritant (eg capsicum or tear gas) rounds. Generally the non lethal munitions used in 40 mm, 37 mm or 12 gauge weapons are designed to be used only within a prescribed or fixed zone of employment. In other words the weapon can only be fired safely within a certain range or distance band.

This fixed "zone of employment" results from the fact that current non lethal munitions are fired with fixed launch velocity and hence manufactures optimise their ammunition to meet a specific set of design requirements unique to that zone. For example, the M1006 point impact non lethal round used by US and Australian defence forces is designed to be fired between a minimum range and a maximum range out to 50 m. The fixed launch velocity of the round limits its use to this zone and hence the round is considered to be unsafe to employ under 10 m, and ineffective beyond 50 m. In reality, the sweet spot at which the round is safe and effective is smaller than this "optimum" zone. Such problems are typical of such systems.

The difficulty faced by the military user of non lethal weapons systems is that modern complex asymmetric type operations dictate that the scenarios are wide and varied and hence these weapon systems should be as flexible as possible to meet the changing engagement circumstances. Current approaches have consequently led to the undesirable requirement to carry multiple ammunition types (each with their own zone of employment which may or may not overlap) or to limit the employment options to a tight set of conditions which severely restricts the user's options in the field. Logistically this burdens the operation by requiring the organisation to carry and support a range of munitions options.

Some attempts have been made in the past to construct variable velocity munitions for other applications. These have typically used multiple propellant charges which are selectively ignited, however these suffer from a range of deficiencies making them unsuitable for use in the non lethal setting. For example some systems include propellant in the projectile. When the projectile is not fired to the maximum range (common in non lethal settings), not all of the propellant is consumed, leaving the projectile in an unsafe state which is undesirable in a non lethal scenario. Another system includes selectable charges located in the cartridge. However this creates safety issues for the user of the system, as when the projectile is not fired to the maximum range the ejected casing will still contain unconsumed propellant.

There is thus a need to provide a non lethal weapons system that is suitable for safe and effective use over a wider employment zone than current systems, or at least to provide users of existing systems with a useful alternative.

SUMMARY

According to a first aspect, there is provided a cartridge for firing a projectile with a selectable launch velocity, the cartridge comprising:

- a casing;
- a plurality of propellant chambers located within the casing;
- a plurality of primers, each primer operatively connected with one of the plurality of propellant chambers for initiating the propellant in the respective chamber;
- a projectile located in a forward end of the casing;
- a cavity formed between the forward end of each of the plurality of propellant chambers and the rear of the projectile to receive the propellant gases from one or more of the plurality of propellant chambers to fire the projectile from the casing; and
- a primer interface module located in a rear end of the casing for selectively initiating one or more of the plurality of primers to fire the projectile from the casing, and wherein in use, after firing the projectile from the casing, the remaining primers are initiated after a delay to initiate the remaining propellant in the cartridge and render the cartridge safe.

In a further aspect, the primer interface module comprises at least one electrical contact for receiving one or more signals from a fire controller to selectively initiate one or more of the plurality of primers. The at least one electrical contact may comprise a plurality of electrical contacts, each electrical contact electrically connected to one of the plurality of primers. The electrical contacts may comprise a plurality of concentric annular tracks of conductive material in a rear surface of the casing. The number of propellant chambers and the number of primers may be three.

In a further aspect the primer interface module further comprises a decoder circuit for decoding one or more signals received from the at least one electrical contact to enable selection and initiation of one or more primers from the plurality of primers.

In a further aspect the forward end of each of the propellant chambers further comprises a selectively rupturable seal for sealing the end of the respective propellant chamber from the cavity, wherein if primer is selectively initiated and initiates propellant in the associated chamber, the associated seal ruptures to release propellant gas into the cavity, and a primer is not selectively initiated, the associated seal is resistant to rupturing due to the presence of propellant gas in the cavity from propellant chambers which were selectively initiated.

In a further aspect the plurality of propellant chambers are uniformly distributed around a central axis of the casing. In a further aspect each of the propellant chambers comprises the same quantity of propellant, or alternatively each of the propellant chambers comprises a different quantity of propellant. In a further aspect the primer interface module comprises a cartridge identifier to allow a firing controller to determine the type of the cartridge.

According to a second aspect, there is provided a fire control apparatus for selectively initiating one or more of a plurality of primers in a cartridge comprising a plurality of primers, a plurality of propellant chambers and a projectile, wherein each primer is operatively connected to a propellant chamber to allow the projectile to be fired from the cartridge with a selectable launch velocity, the fire control apparatus comprising:

a user interface for receiving a firing signal; and a firing controller in electrical communication with the cartridge, wherein the firing controller is configured to generate one or more signals in response to a firing signal to select and initiate one or more of the plurality of primers in the cartridge, and after a time delay which is sufficient to allow the projectile to be expelled from the cartridge, generates a further one or more signals to initiate the remaining primers in the cartridge so as to render the cartridge safe.

According to a further aspect, the user interface allows the user to select a firing mode (eg using a selector), and the firing controller selects which of the plurality of primers to initiate from the selected firing mode. In a further aspect the firing controller further comprises one or more pins for electrical connection with one or more electrical contacts in the cartridge. The one or more pins may comprise a plurality of pins, each pin located to align with an electrical contact in a base of the cartridge for providing one or more signals to each one of the plurality of primers, and the firing controller comprises a selector for selecting which pins to send a signal to in response to a received firing signal. Alternatively the one or more pins comprises a single pin, and the firing controller further comprises an encoder for encoding information for selecting the primers to be initiated on one or more signals sent to a cartridge via the single pin.

According to a further aspect the firing controller further comprises a primer testing module for sending one or more signals for testing the status of each of the plurality of primers. In a further aspect the primer testing module tests the status of all of the primers after generation of the further one or more signals to initiate the remaining primers, and the user interface comprises at least one indicator for indicating a safety status of cartridge after firing of the projectile, wherein if the primer test module indicates all primers have been initiated a safe status is indicated, and if not all of the primers have been initiated, then a hazard status is indicated to alert a user that the cartridge comprises unused propellant. The indicator may be a visual indicator and may be at least one LED indicator or a dual green/red LED.

According to a further aspect the user interface comprises a selector for allowing a user to manually select a fire selection mode. In a further aspect the apparatus further comprising a range finder for estimating the range to a target, and the firing controller selects which of the plurality of primers to be initiated in response to a firing signal using the estimated range to the target. In a further aspect the fire controller further comprises a memory comprising a plurality of cartridge types, and communicates with the cartridge to receive a cartridge identifier determine the type of the cartridge, and selects which of the plurality of primers in the cartridge to be initiated in response to a firing signal from the determined cartridge type. According to a further aspect the fire control apparatus is adapted to be retrofitted to an existing weapon platform. In a further aspect the delay is between 5 ms and 1 second. In a further aspect the delay is at least 10 ms and 100 ms.

According to a third aspect, there is provided a method for firing a projectile with a selectable launch velocity from a cartridge and subsequently rendering safe the cartridge, the cartridge comprising a plurality of primers, a plurality of propellant chambers and the projectile, wherein each primer is operatively connected to a respective propellant chamber to allow the projectile to be fired with the selected launch velocity, the method comprising:

selecting one or more of the plurality of primers;

initiating the selected one or more primers to fire the projectile; and initiating, after a time delay, the remaining primers so as to initiate the remaining propellant in the cartridge and render the cartridge safe In a further aspect, the method includes the further step of testing the primers by sending a test pulse to each primer after receiving a firing signal, and aborting firing if the primer test indicates one or more of the primers is faulty. In a further aspect the method includes the further step of testing the primers on loading a cartridge into the weapon, and providing an indication to the user if a cartridge is unsafe to use if one or more of the primers is detected as faulty. In a further aspect the method includes the further step of testing if each primers is in an open circuit state after the second firing signal, and indicating to the user whether the safety status of the cartridge, wherein if all primers are in an open circuit state a safe status is indicated, otherwise an unsafe status is indicated.

According to a fourth aspect of the present invention, there is provided a weapon for firing a projectile with a selectable velocity, the weapon comprising:

a barrel for receiving a cartridge as described above in the first aspect;

a firing control system as described in the second aspect.

In a further aspect weapon further comprises a laser range finder configured for detecting ranges between 3 m and 500 m. The laser range finder may be coupled to the firing control system to automatically select the propellant chambers to ignite to achieve the desired range.

BRIEF DESCRIPTION OF DRAWINGS

A preferred embodiment of the present invention will be discussed with reference to the accompanying drawings wherein.

In the following description, like reference characters designate like or corresponding parts throughout the figures.

DESCRIPTION OF EMBODIMENTS

Figure 1:
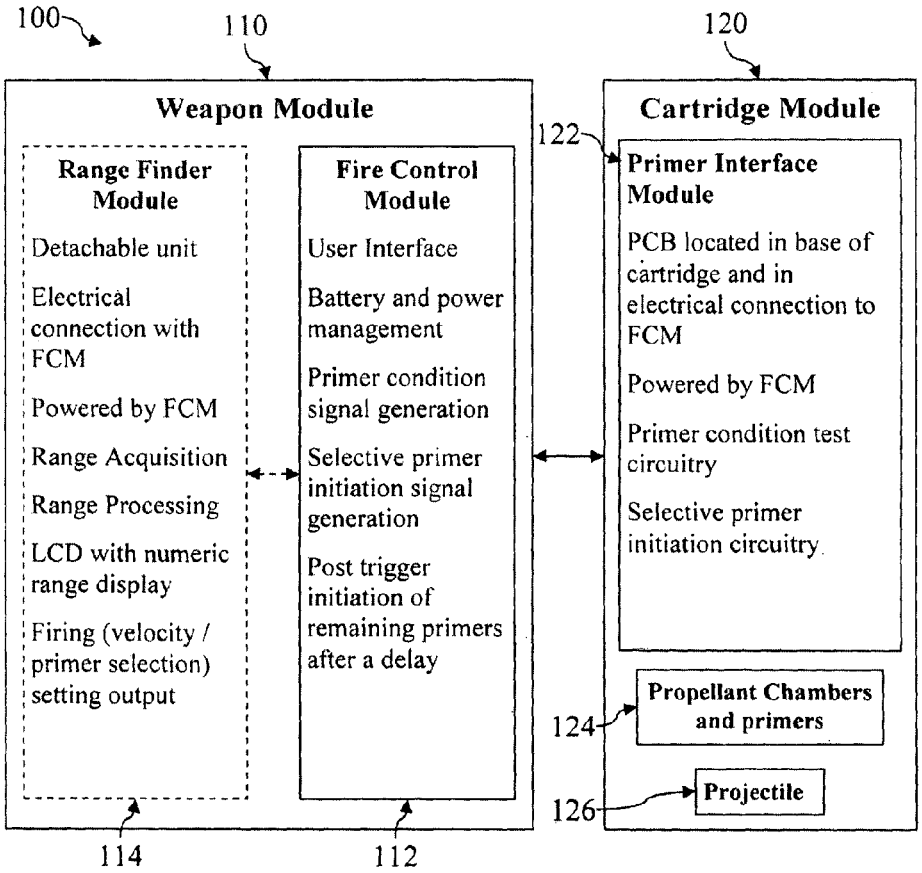
FIG. 1 is a block diagram of the a non lethal weapon system according to an embodiment.

FIG. 1 is a block diagram of a weapon system 100 which has been developed for firing (or expelling) a projectile from a cartridge (and thus a weapon) having a plurality of selectively ignitable (fireable) propellant chambers according to an embodiment. This enables firing of a projectile at a range of selectable launch (or initial or exit) velocities. That is the projectile has a variable exit velocity from the weapon, which is particularly suited for use with non lethal projectiles (and which addresses several of the previously identified problems). A second firing signal is issued after a delay to fire any remaining charges so as to render the cartridge safe after firing. In another embodiment the selected charges are initiated in sequence (rather than being initiated all at the same time, i.e. synchronously), so as to provide an extended pressure impulse for accelerating projectiles (and in particular heavy projectiles). Alternatively a cartridge can contain different projectiles, which can be selected and fired depending upon the threat. The system comprises a weapon module 110 and a cartridge module (or round) 120. The cartridge module 120 comprises a projectile 126, a plurality of selectively ignitable propellant chambers 124 for propelling the projectile at a desired (or selected) velocity, and a primer interface module 122 which receives firing commands to selectively ignite one or more of the propellant chambers.

Referring to FIG. 1, the weapon module 110 includes a fire control module 112 (also referred to as the fire control unit or FCU) which provides power to the system and controls selective firing of propellant chambers in the cartridge (once loaded into the weapon). An optional range finder module 114 may be used to detect the target range and automatically select the required firing mode (ie which propellant charges) and provide this information to the fire control unit for use once a firing request is received by the fire control module (ie trigger pulled). The range finder module may be a laser based system. In one embodiment the laser range finder is designed for use over short ranges (and in particular 0-50 m) typical of non lethal engagements. A laser range finder can significantly enhance the accuracy and effectiveness of the system at such short ranges.

The fire control module 112 of the weapon module 110 is either mounted onto the chassis of an existing weapons platform or for the standalone case, is integrated in the weapon chassis. The fire control module (or apparatus) provides the user interface for the system and firing control functionality (eg using a firing controller). The fire control module includes a battery for powering the system and various circuit modules (mounted on a PCB) for providing power management for the system, monitoring of the primer condition in a loaded cartridge to test that a loaded cartridge is safe for use, and for issuing signals for selective initiation (detonation) of primers in the cartridge to fire the projectile at a desired velocity. The fire control further issues a post trigger initiation (detonation) of remaining propellant charges in the cartridge so as to render the cartridge safe after firing, and can perform a check that all primers have been fired to enable a firing status to be provided to the user (casing is safe to eject, or alternatively may have unused propellant and thus be a hazard). The fire control module can also test the cartridge on loading to indicate if the cartridge is safe to fire or alternatively has faulty primers. The fire control module will also be referred to as the firing module, firing controller or weapon module.

The primer interface module 122 is located within the cartridge module 120 along with a plurality of propellant chambers, each with an associated primer for initiating or detonating the propellant in that chamber 123, and a projectile 126. The primer interface module includes a PCB circuit board with one or more electrical contacts provided in the base of the cartridge. When the cartridge is loaded into the barrel, a direct electrical connection is made between the primer interface module and the fire control module, and is used to provide both power and signals such as communication signals, test signals or firing signals, to the primer interface module from the firing control module. The primer interface module includes circuits for testing the primer, and for initiation (detonation or firing) of the primers. The electrical connection may be a single connection over which encoded signals for selection of primers to fire are sent, or there may be individual connections provided to each primer for initiation of the associated propellant chamber. In this case circuitry for selection of primers to fire is included in the fire control module and only minimal circuitry for initiation of primers is required in the cartridge, which simplifies construction and increases the robustness of the cartridge. More complex arranges could be envisaged in which a direct electrical connection is not used (eg wireless communication of firing signals), however these are generally more complex and expensive as they require additional safety and a power source (or charge storage device which is charged by the fire controller).

Variations are possible, and different components may implement the various features in different embodiments. That is some of the range finder features may be implemented in the microcontroller of the fire control module, and similarly some of features in the firing control module may be implemented in the cartridge module and vice versa.

The choice of whether to use a single electrical connection with encoding in the cartridge or multiple connections (one for each primer) will depend upon factors such as the expected operational environment and implementation preferences. The system requires a robust electrical connection between the weapon module and the cartridge, and one that is not sensitive to the effects of dust, dirt, corrosion, wear etc. Providing multiple connectors (ie one pre primer/propellant chamber) simplifies the circuitry required in the cartridge (since no decoding operations are required), and allows more robust primer testing making the cartridge cheaper and potentially more robust to damage. However as the number of electrical connectors increases, the overall risk of the system being compromised by failure of an individual connector increases. However by making fire control unit, and the connection component replaceable this problem can be minimised/rectified by quickly swapping the fire control unit, and/or connector module. A single connector reduces this risk, but adds additional complexity and cost to the cartridge, and may make the cartridge more susceptible to damage. Further to enable accurate primer testing, primers in the cartridge must be more carefully selected to ensure the primers have the expected resistances (ie tighter tolerances are required for the 1 connector case compared to the 3 connector case). This will likely drive up the cost of manufacture of cartridges.

The range finder module 114 (if included) is located on the weapon platform and is either provided as a separate detachable module which is mounted on an existing weapon platform, or included in the weapon chassis. The range finder module includes a PCB and associated components such as a laser transmitter, receiver, optical assembly, processor, memory etc, which perform range acquisition, and range processing (ie ballistic calculations) to determine which propellant chambers in the cartridge should be initiated to reach the target. Power and signals are provided from the fire control module over an electrical connector (preferably external) which is also used to send control signals between the two modules. The range finder module may provide a numeric range display on a LCD and provides a signal indicating the firing mode or setting which is sent to the fire control unit. The range finder may generate a fire selection mode signal to the fire controller to indicate which propellant chambers to initiate or the desired velocity or range mode to be used. The range finder module may include a ballistics module to take into account ballistic effects in determining the required number of propellant chambers to be fired.

The most commonly used non lethal round in service with US and Australian defence forces is the M1006 point impact non lethal 40 mm round which may be fired from a M203 40 mm grenade launcher. The M203 40 mm grenade launcher is a weapon platform which may be fitted below the main barrel of many in service weapons such as the F88 AusSteyr, or M4 Carbine. Various embodiments of a system collectively referred to as the Managed Lethality Grenade Launcher System (MLGLS) will now be described which is based around the M203 40 mm grenade launcher. However it is also to be understood that whilst the system has been described in the context of a 40 mm grenade launcher for non lethal projectiles, the underlying principles and modular approaches could be applied to a range of other calibre weapons (37 mm, 12 mm shotguns, etc), as well as ammunition types including electrical (eg Taser™), capsicum, tear gas, flares, buckshot and high explosive projectiles.

Figure 2A:
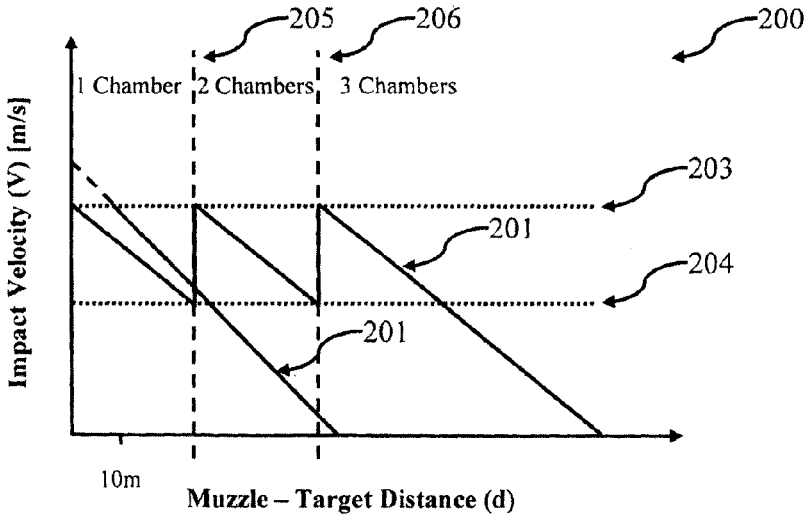
FIG. 2A is plot of the impact velocity versus Muzzle-Target distance (ie range) for a projectile fired by the M1006 system and the MLGLS according to an embodiment.
Figure 2B:
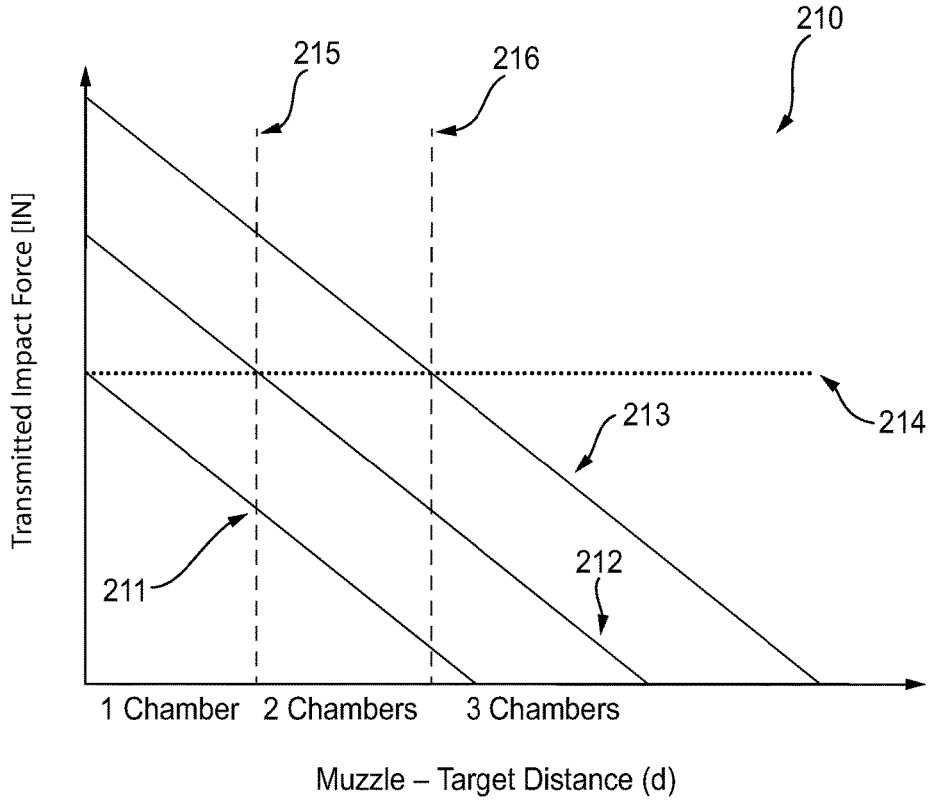
FIG. 2B is a plot of the transmitted impact force as a function of the Muzzle-Target distance of a projectile fired by the MLGLS based upon ignition of 1, 2 or 3 propellant chambers in a 40 mm cartridge used by the MLGLS according to an embodiment.

The MLGLS system provides the user with the ability to autonomously or manually change the launch velocity of the non lethal (NL) projectile and hence optimise the impact effect on the target independent of the target's stand off range. FIG. 2A shows a plot 200 of the impact velocity versus Muzzle-Target distance (ie range) for a projectile fired by the M1006 system 203 and the MLGLS system 204. The maximum desired impact velocity is indicated by dotted line 201 and the minimum desired impact velocity is indicated by dashed line 202. Vertical dashed lines 205 and 205 indicated the transition distances (ranges) at which the number of propellant chambers to fire is incremented to increase the impact velocity to maintain it between the desired ranges (ie between lines 203 and 204). FIG. 2A indicates that the M1006 has a more limited range, and exceeds the maximum impact velocity at ranges of less than 10 m. In comparison the MLGLS system, which has a sawtooth pattern owing to the ability to boost the impact velocity by ignition of additional chambers when the velocity drops below line 204, has a greater range over which the impact velocity is within the desired impact velocity range. That is the MLGLS can deliver non lethal projectiles over a wider range of impact velocities compared to the M1006 system. FIG. 2B shows a plot 210 of the transmitted impact force as a function of the Muzzle-Target distance for a projectile fired by one 211, two 212 or three 213 propellant chambers. The maximum desired transmitted impact force is indicated by dotted horizontal line 214, and vertical dashed lines 215 and 216 indicate transition the transition distances (ranges) at which the number of propellant chambers to fire is incremented to increase the impact force and raise it up or to the maximum 214. FIG. 2A illustrates that as the transmitted force drops with range, further propellant chambers can be ignited to increase the exit velocity of the projectile, and thus increase the transmitted impact force. Thus different firing modes (ie which propellant chambers) can be selected based upon the range to the target to optimise the impact force on the target.

Figure 3A:
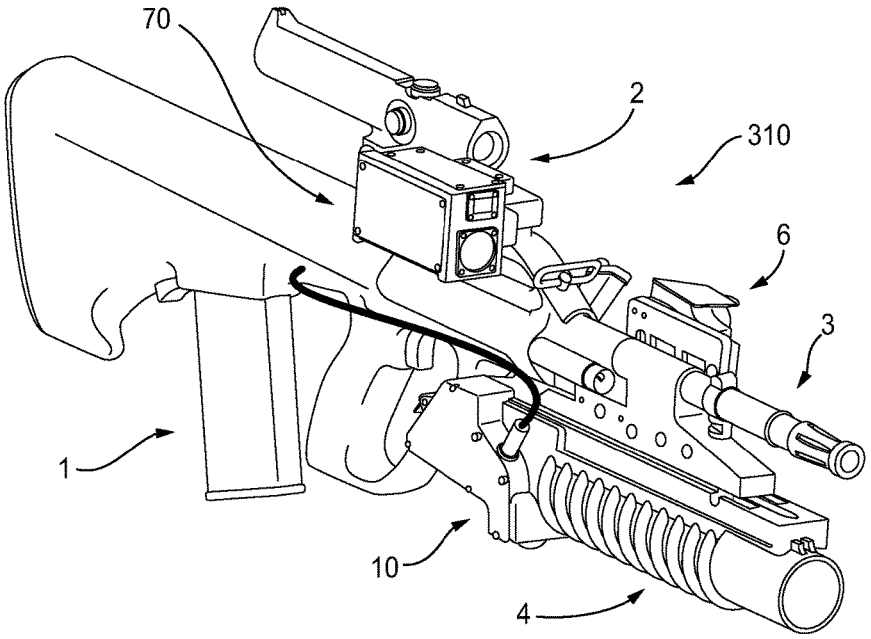
FIG. 3A is perspective view and FIG. 3B is a side view of the Managed Lethality Grenade Launcher System (MLGLS) retrofitted onto a M203 40 mm grenade launcher mounted on an F88 AusSteyr rifle.
Figure 3B:
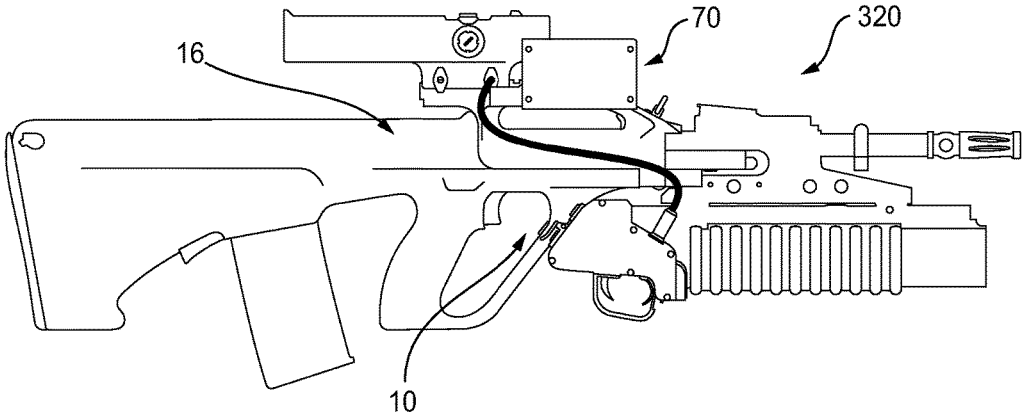
Figure 4A:
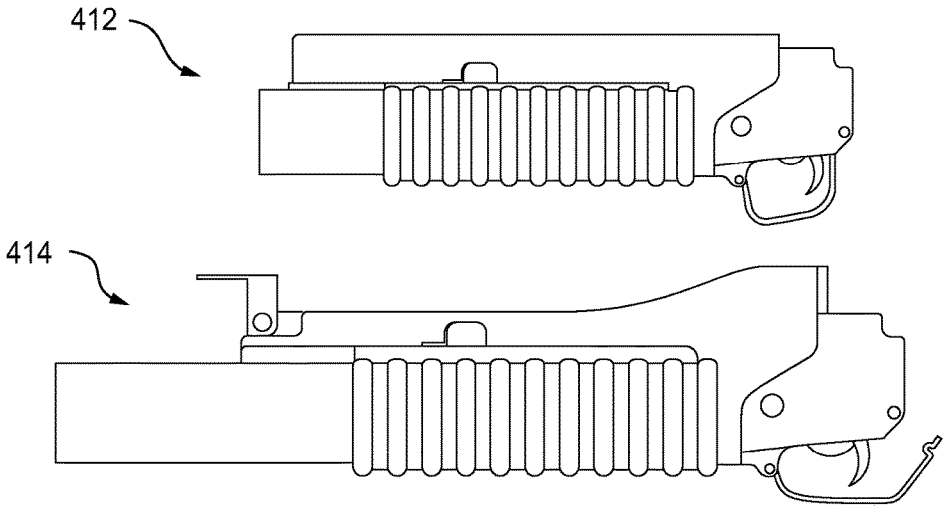
FIG. 4A illustrates a short barrel variant and a long barrel variant of the M203 according to an embodiment.
Figure 4C:
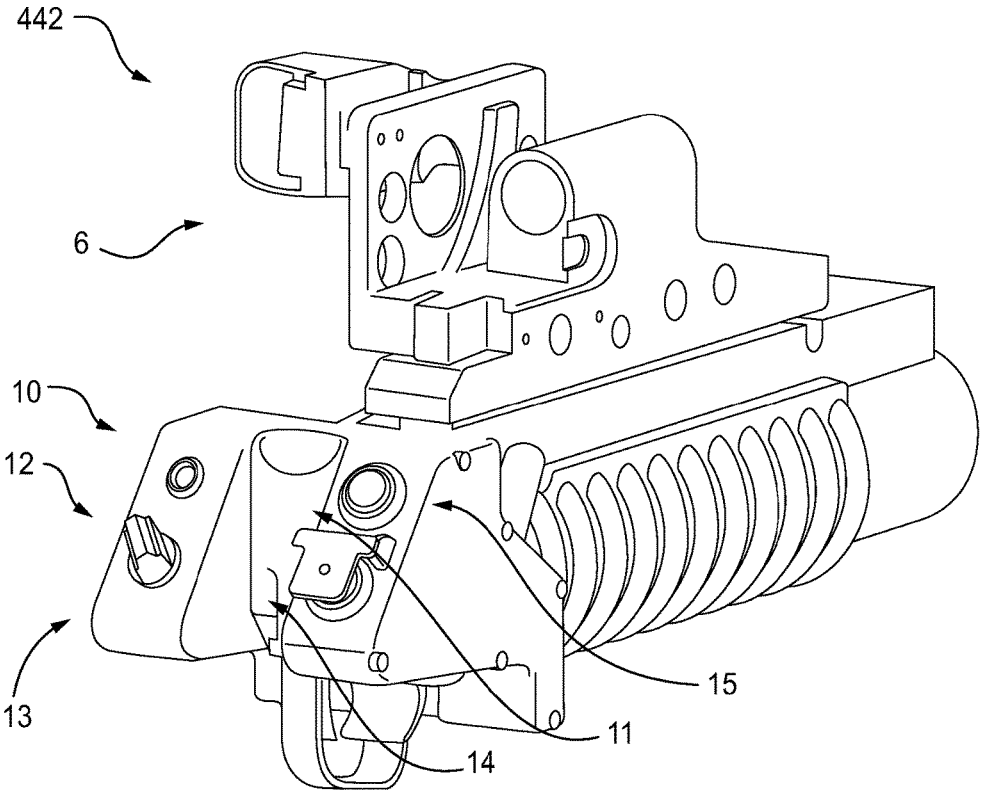
FIGS. 4C and 4D illustrate side and reverse side (respectively) perspective views of the fire control module of the MLGLS fitted over the trigger end of a M203 according to an embodiment.
Figure 4B:
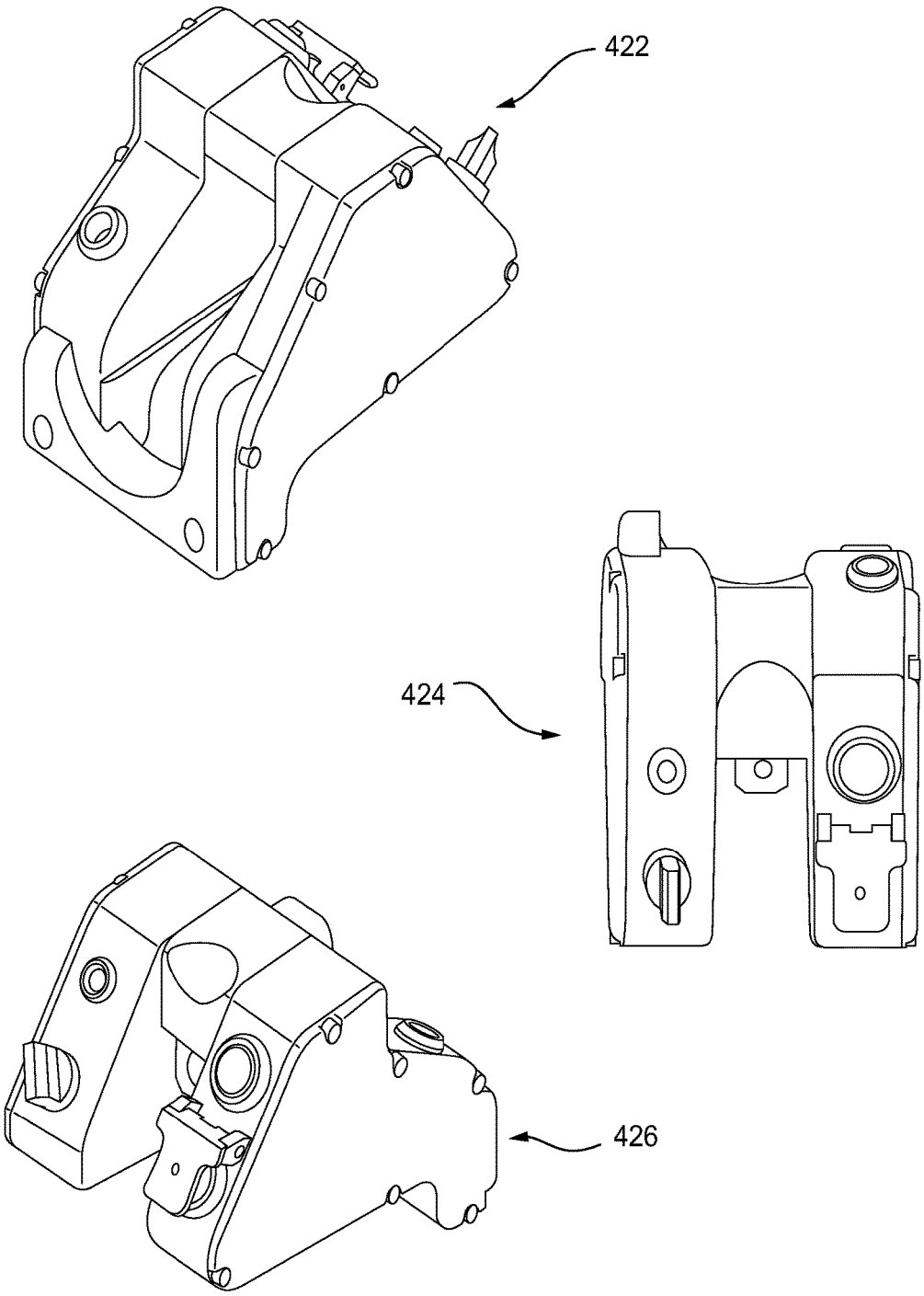
FIG. 4B illustrates various views of the fire control module which is fitted over the rear (trigger) end of a M203 barrel according to an embodiment.
Figure 4D:
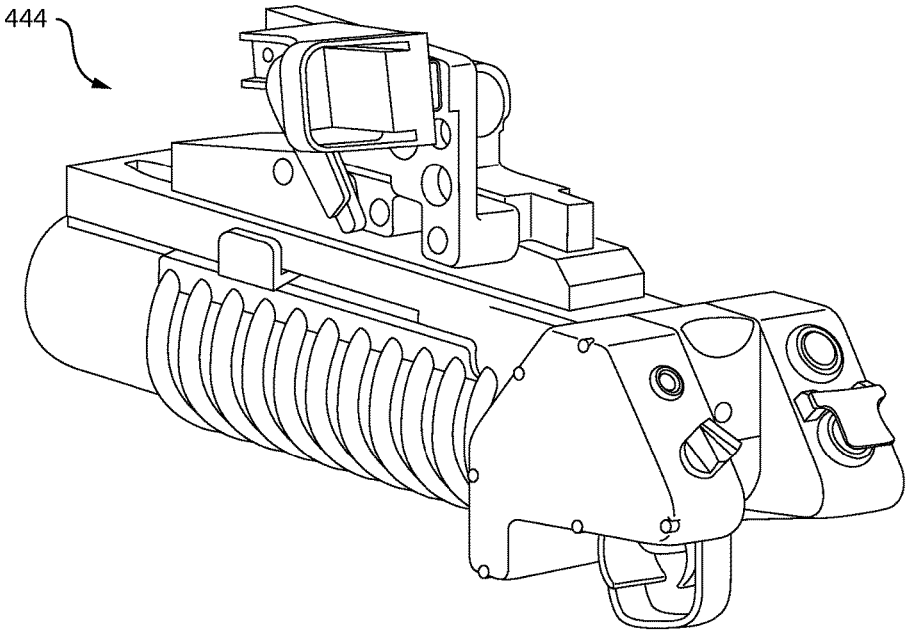

The system can be readily adapted for use with commercial or military off the shelf (COTS/MOTS) systems with minimal changes to the weapon hardware and importantly does not prevent such enhanced weapons from using conventional in-service ammunition. This provides flexibility for the user (primarily soldiers) and allows them to rapidly switch from non lethal to lethal ammunition in response to a change in the threat. FIG. 3A provides a perspective view 310 and FIG. 3B provides a side view 320 of the MLGLS comprising a fire control module 10 fitted onto to an M203 40 mm grenade launcher 4 mounted on underneath barrel 3 of an F88 AusSteyr rifle 1, along with a range finder module 70, mounted adjacent the weapons optical sight 2. The fire control unit 10 is connected to the range finder module 70 via cable 16. A mechanical sight 6 is also provided adjacent to the M203 barrel 4. FIG. 4A illustrates side views of long 412 and short barrel 414 variants of the M203 for use with different weapon platforms and FIG. 4B illustrates various views 422 424 426 of the fire control module 10 prior to mounting over the M203 barrel 4. Mounting is performed by sliding the fire control module over the end of the barrel so that the fire control module saddles the trigger end of the M203 barrel 4. This is further illustrated in FIGS. 4C and 4D illustrate side 442 and reverse side 444 (respectively) perspective views of fire control module of the MLGLS fitted over the trigger end of a M203 barrel. These figures further illustrate a mechanical or manual sight 6 located to the left of the barrel to provide basic aiming when then range finder module 70 is not fitted to the weapon.

Figure 4E:
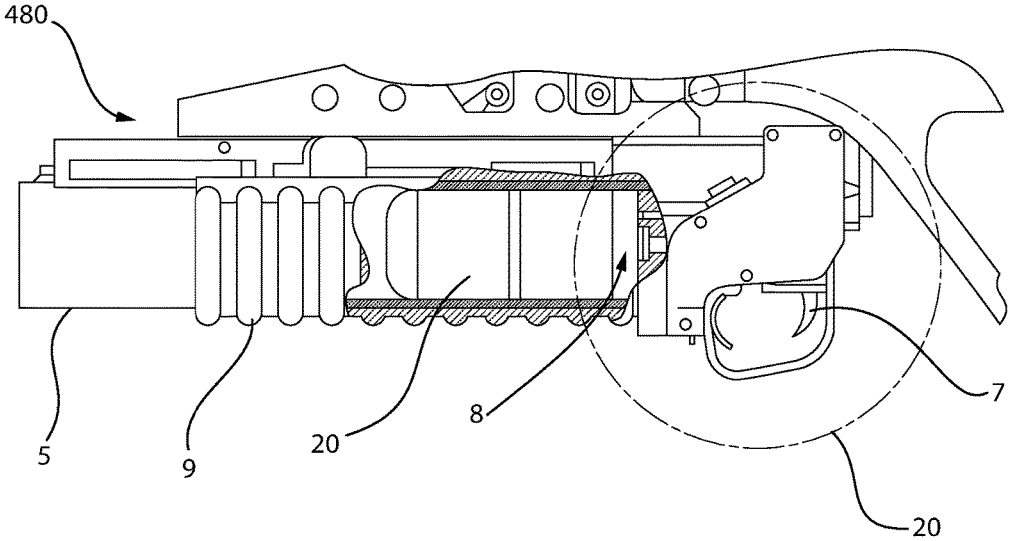
FIG. 4E is a side view of an F88 AusSteyr fitted with the MLGLS showing a partly cut-away view of the breech loaded with a variable velocity cartridge according to an embodiment.

A user interface to the fire control module is provided on the rear face of the fire control module 10 and comprises a manual range selector button 11 to manually activate the range finder and report the distance to the user, a status LED 12, a dual mode selector and power switch 13, and a trigger 14 (with associated trigger guard). The dual mode selector has an off mode (0), and automatic mode (A) and three manual modes (1, 2, 3). The off mode powers the system off. The automatic mode performs automatic range finding and selection of primers to fire (based on the range) upon a trigger press. The manual mode manually selects the number of primers (and associated propellant chambers) to fire. This allows independent use without the range finder module. If the automatic mode is selected, but no range finder module is connected to the fire control module, then a default mode is selected (typically 1 primer). A connector 15 is provided for connecting the fire control unit to the range finder if present to provide power to the range finder, and to allow communication between the two modules. Finally FIG. 4E shows a partly cut-away side view 480 of the M203 barrel 4 with the breech loaded (by sliding slide 9) with a 40 mm cartridge (or round) 20 which includes 3 individually selectable primers and propellant chambers to propel a projectile with a variable velocity.

Figure 5A:
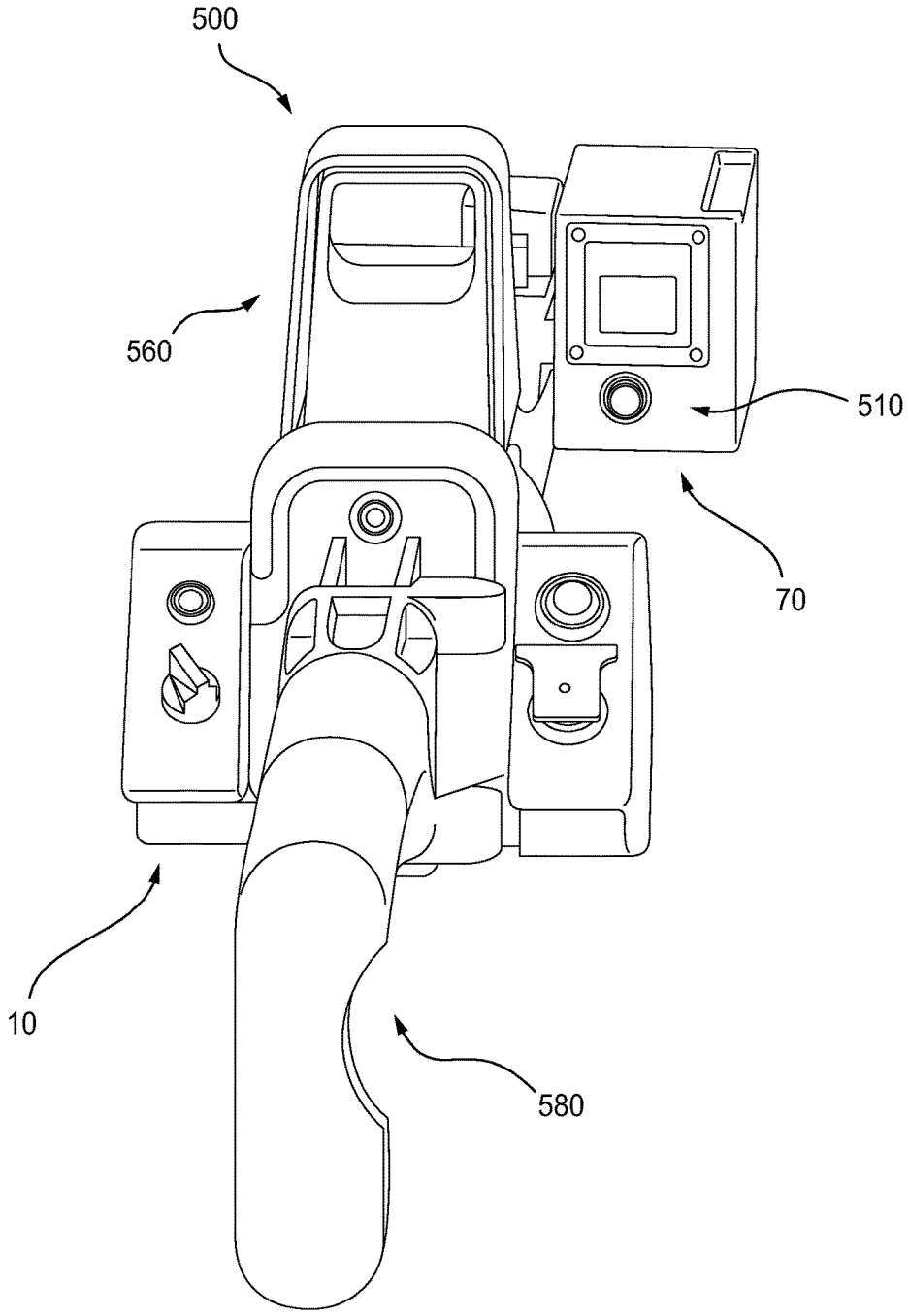
FIG. 5A is a rear perspective view of a standalone version of the MLGLS and FIG. 5B is a side. perspective view of a standalone version of the MLGLS and cartridges for use in the MLGLS according to an embodiment.
Figure 5B:
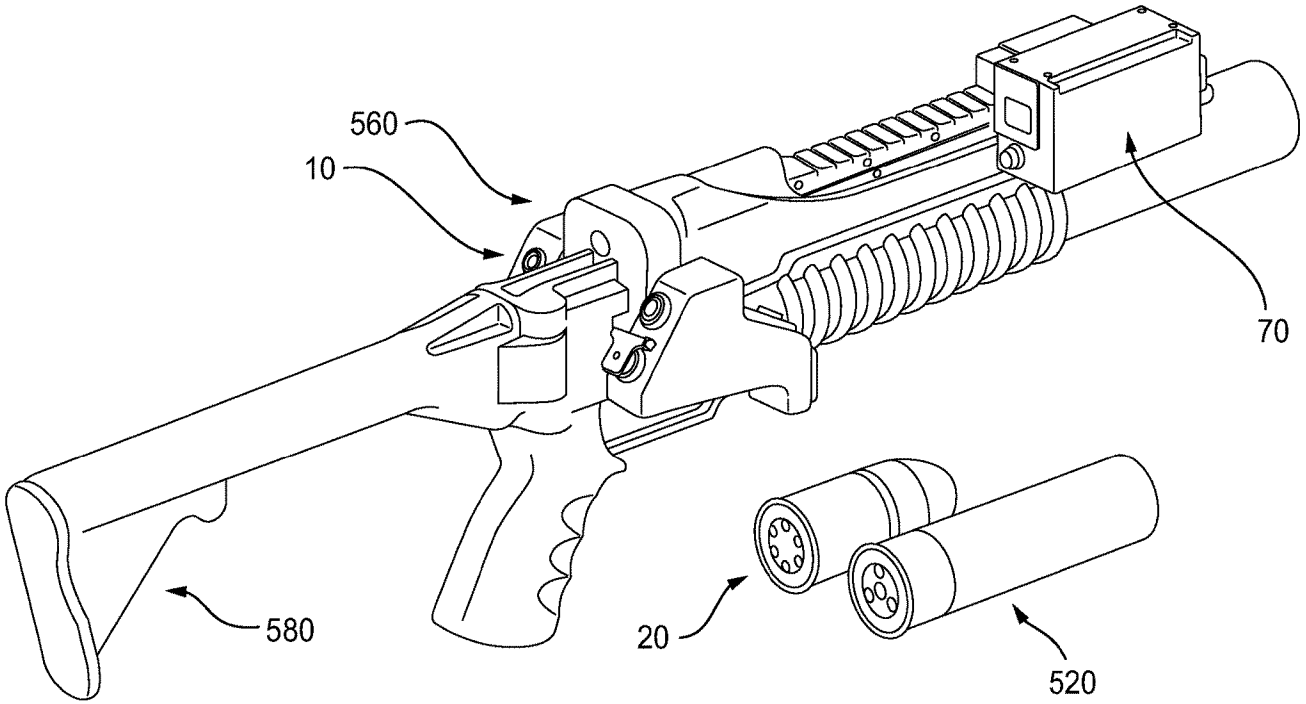

Alternatively the MLGLS system can be provided as a standalone weapon system or platform which may be more suitable for use by civilian forces, or in aid or peace keeping roles. FIG. 5A illustrates a rear perspective view 500 of a standalone (ie dedicated) MLGLS, and FIG. 5B is a side perspective view of a standalone version of the MLGLS and cartridges for use in the MLGLS. In this embodiment the main barrel is a M203 40 mm grenade launcher barrel with the fire control module 10 located directly behind the barrel. The fire control module is located over the end of the barrel and just prior to the stock 580. The system further includes a mechanical sight 560 located above the barrel along with a laser range finder 70 which is located adjacent and slightly to the right of the manual sight 560. A first 40 mm cartridge 20 which includes 3 individually selectable primers and propellant chambers (indicated in the barrel in FIG. 4E) is indicated along with a second 40 mm cartridge 520.

FIGS. 6A to 6D show an exploded perspective view 610 and an exploded side view 620, a cross sectional view 630, and a perspective view 640, (respectively) of a 40 mm cartridge (or round) 20 which in this embodiment includes 3 individually selectable primers and propellant chambers to propel a projectile with a variable (or selectable) exit velocity from the MLGLS or other weapon system. The cartridge 20 comprises a casing 50 which contains a primer interface module 30 in the rear of the casing for selective initiation of one or more of three propellant chambers 40 located within the casing. A projectile 60 is located in the forward end of the casing, so that a cavity 62 is formed between the propellant chambers 40 and the projectile 60. Initiation (or detonation) of one or more of the propellant chambers, and subsequent venting of propellant gases into the cavity will project the projectile from the casing and then the barrel and then towards the target. The exit velocity of the projectile from the barrel will depend upon which, and how many, of the propellant chambers are initiated.

Figure 6A:
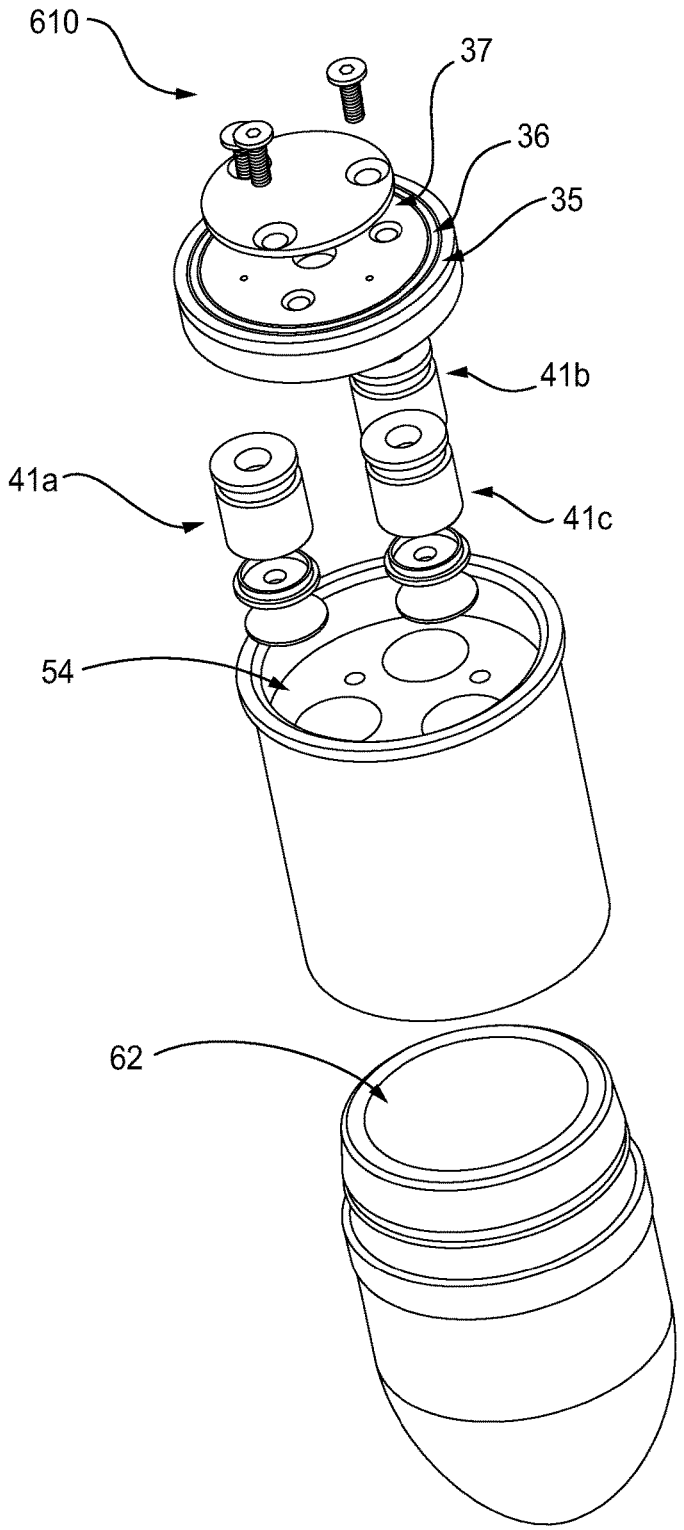
FIGS. 6A to 6D show a cross sectional view, perspective view, exploded perspective view and an exploded side view (respectively) of a variable velocity cartridge for use in the MLGLS according to an embodiment.
Figure 6B:
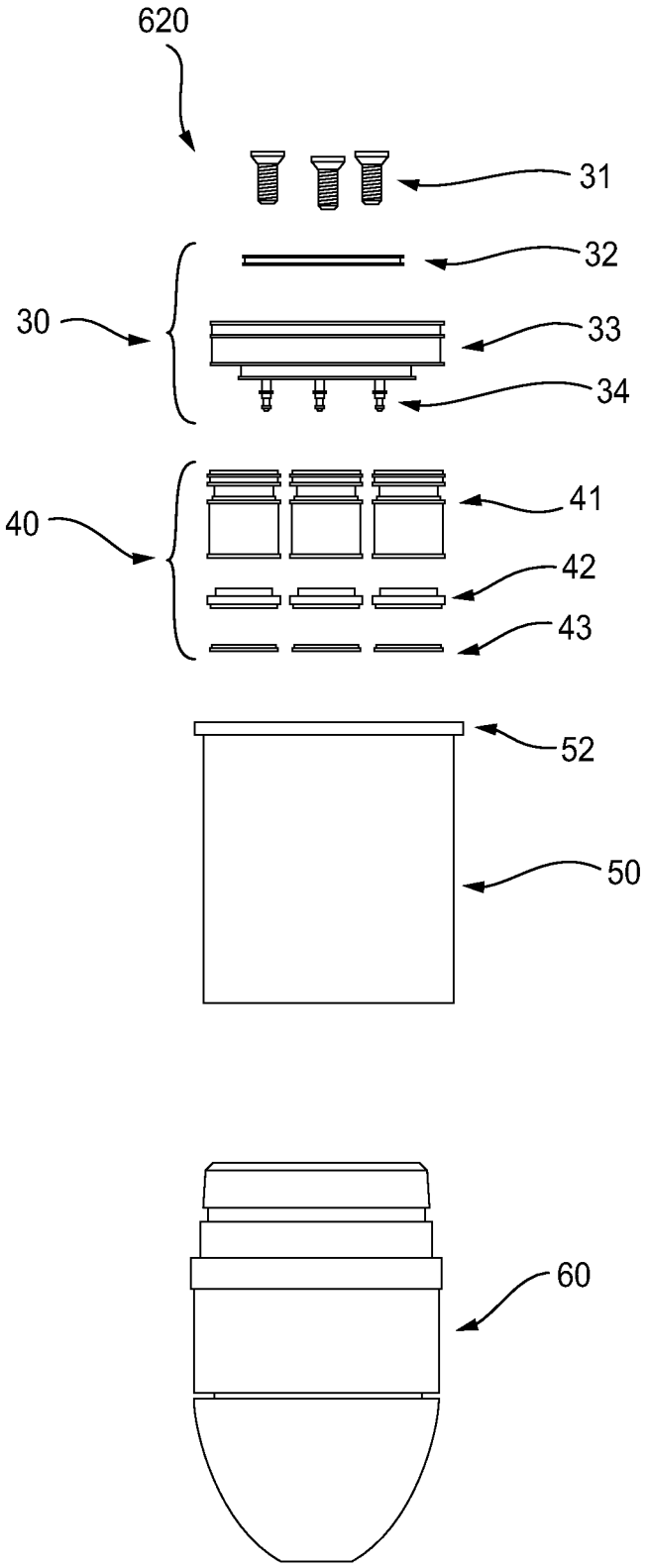
Figure 6C:
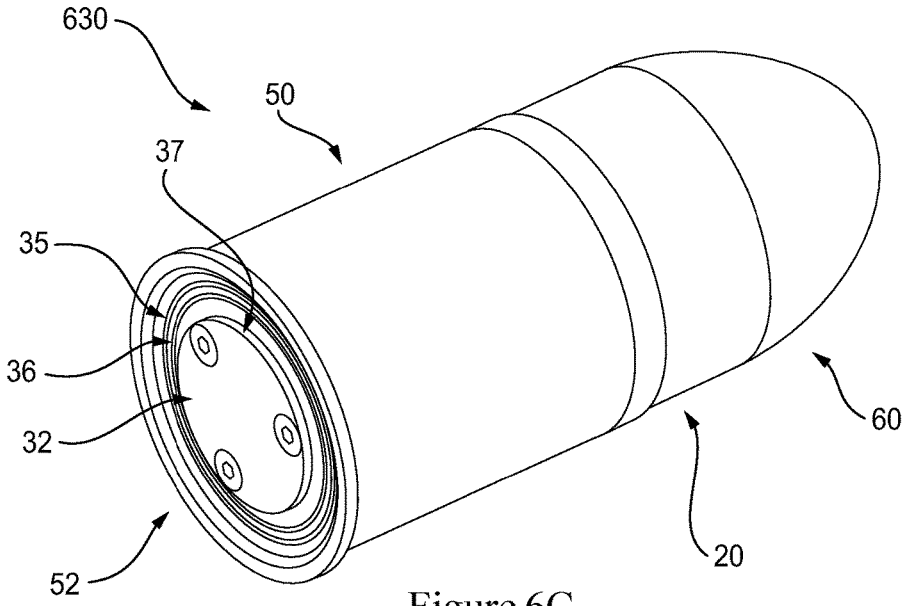
Figure 6D:
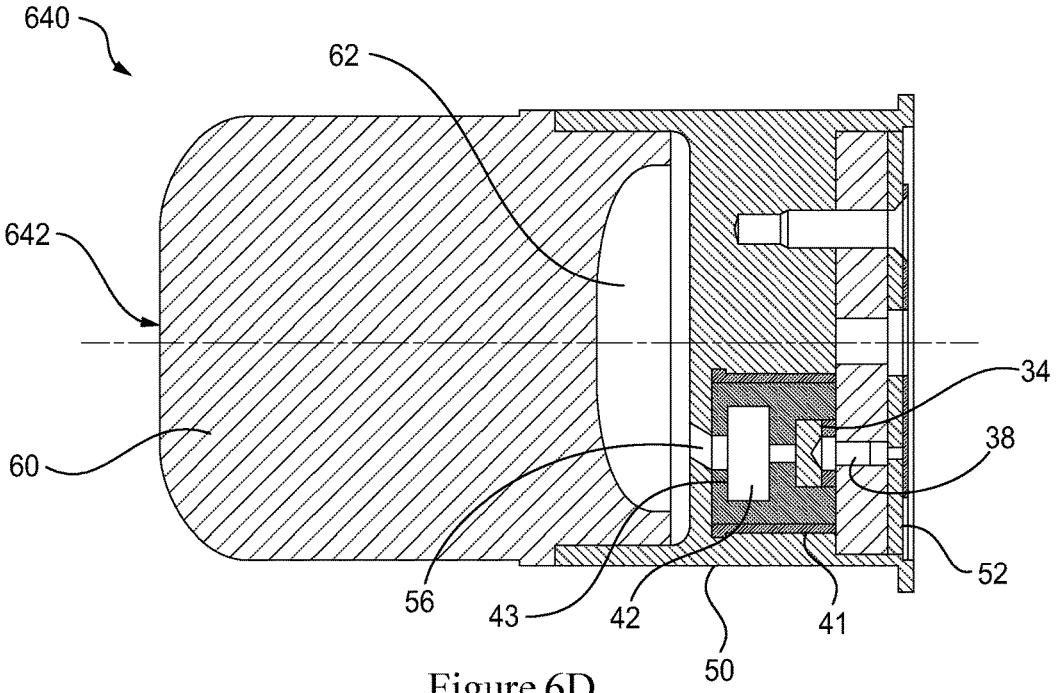

The primer interface module 30 is located in the base of the casing and comprises a PCB circuit board and polycarbonate insulator 33, a base plate 32, and three tamper proof screws for securing the base plate and PCB to the casing block (see FIG. 6D). The rear side of the PCB board comprises three concentric circular contact tracks 35, 36 and 37 which are each electrically connected to each of three electrical primer pins 34 located on the front side of the PCB board and polycarbonate insulator and each of which separately projects into one of the propellant chambers. The propellant module 41 comprises three propellant chambers 41*a* 41*b* and 41*c*, each of which is separately ignitable by one of the propellant pins 34. Thus in this embodiment each track is associated with a single primer pin and single propellant chamber. When an electrical signal is provided on the corresponding track, the signal activates the electric primer which in turn ignites the propellant. The three propellant chambers are uniformly distributed around central axis 642.

The forward end of each propellant chamber 41 is provided with a screw in cap 42 with a venting aperture. A selectively rupturable seal (or buster disc) 43 is provided in front of the cap to seal the propellant in the propellant chamber. A venting chamber 56 is directed from the propellant chamber to the cavity 62. In this case each seal is formed from a 0.1 mm and 0.2 mm brass burster discs to provide a combined thickness of 0.3 mm. If however the propellant in the chamber is initiated, then the build up in pressure due to generation of propellant gas will cause the seal to rupture and vent or release the propellant gas into the cavity 62. However if the propellant is not initiated in the associated chamber, then the seal is resistant to rupturing due to the presence of propellant gas in the cavity from the other propellant chambers. This ensures that only the selected propellant chambers are initiated, and that accidental initiation of the remaining chambers is prevented.

The dimension and size of the burster discs can be varied based upon the type of propellant, and size of the cartridge provided the above functionally is maintained. In one embodiment, the venting of the propellant gas could be controlled using an additional primer in or adjacent the cap. A sealed cap could be used and the second primer could be used to rupture the cap to allow venting of propellant gases into the chamber after a fixed delay. Alternatively a second primer could be used to weaken the strength of the cap and/or burster disc. This may be used to assist in meeting the requirement that the seal provided by the burster discs is not susceptible to rupturing from due to propellant gases released from other charges (ie a stronger or thicker disc can be used). Alternatively a single primer could be used and located in the front end (rather than the rear end) of the propellant chamber. Initiation of the primer would either rupture the burster disk, or weaken the burster disc, so that the subsequent build up in pressure in the propellant chamber leads to rupturing of the burster disc.

Figure 7A:
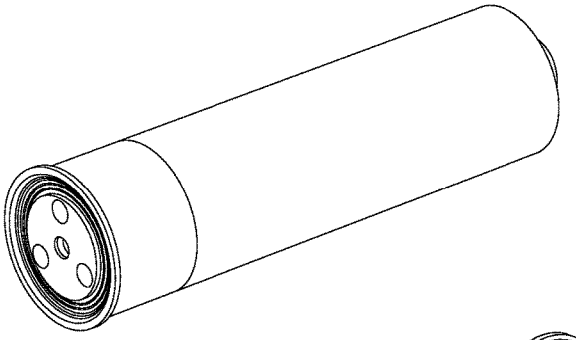
FIGS. 7A, 7B, 7C are perspective views.
Figure 7B:
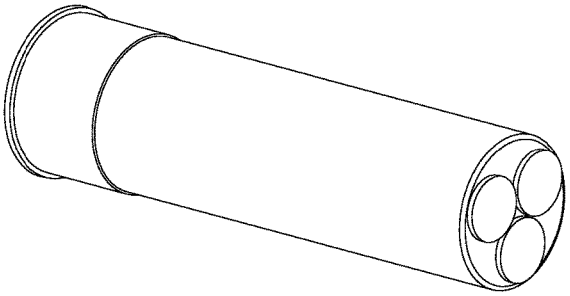
Figure 7C:
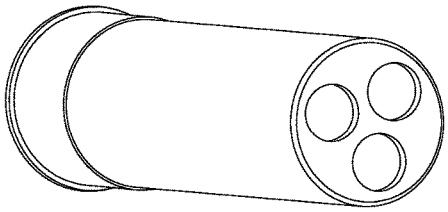
Figure 7D:
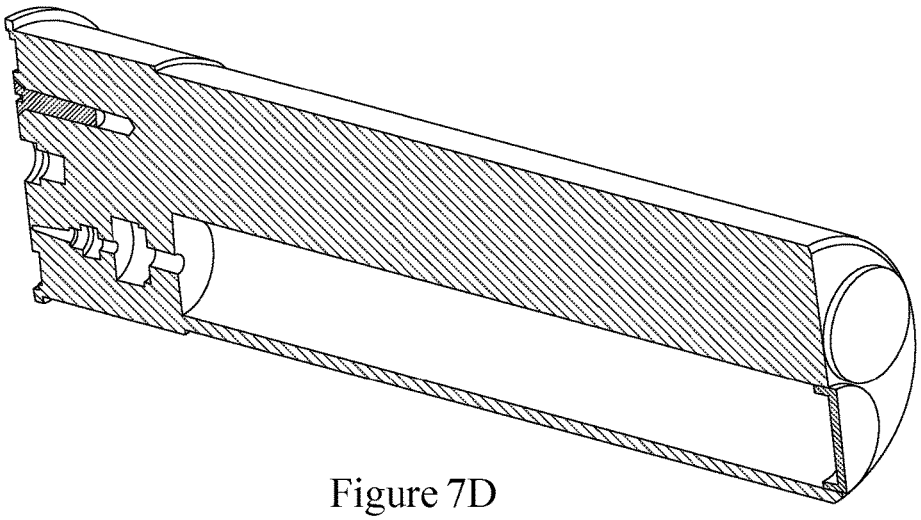
FIG. 7D is a cross sectional perspective view of a cartridge for use in the MLGLS according to an embodiment.

FIGS. 7A, 7B, 7C are perspective views, and FIG. 7D is a cross sectional perspective view of a cartridge 520 with multiple projectiles for use in the MLGLS. In this embodiment, each primer is associated with a separate propellant and a separate projectile chamber containing a plurality of shotgun pellets. FIG. 8B shows the unfired cartridge, and 8C shows the fired cartridge with open projectile chambers. FIG. 8D shows a cross sectional view indicating the propellant chamber and projectile chamber. Thus the cartridge is in effect a selectable 3 shot shotgun cartridge, which via the fire control module, allows the user to individually fire 1, 2 or all 3 of the shotgun projectiles. Alternatively each projectile chamber could be fitted with a different projectile type, such as shotgun pellets, non lethal bean bag, flare, lethal round, etc. This would provide flexibility of use, and increase capabilities.

Figure 8A:
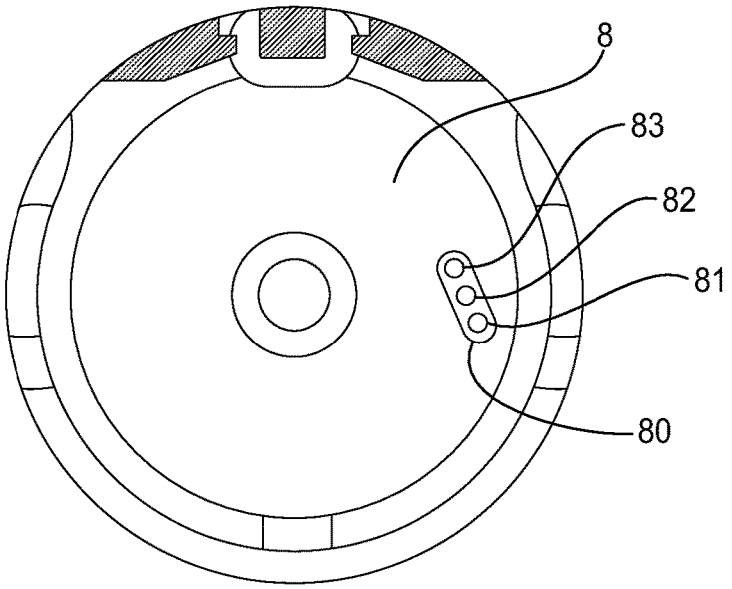
FIG. 8A is front sectional view of the breech of the barrel which receives the base of the cartridge.
Figure 8B:
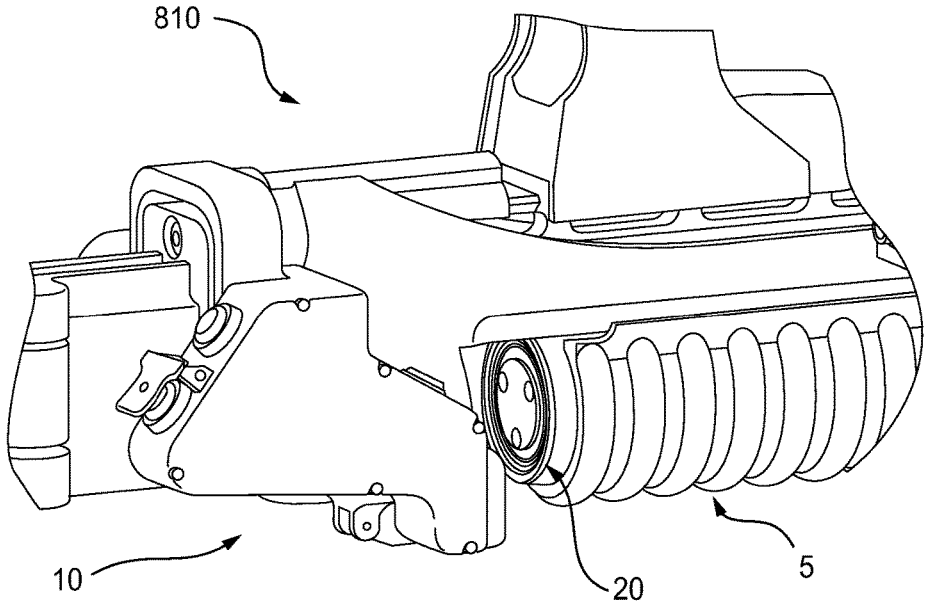
FIG. 8B is a perspective view of the rear of the cartridge as it is being loaded into the barrel and FIG. 8C is a reverse perspective view illustrating the contact pins located in the recess ready to make contact with the rear of the cartridge according to an embodiment.
Figure 8C:
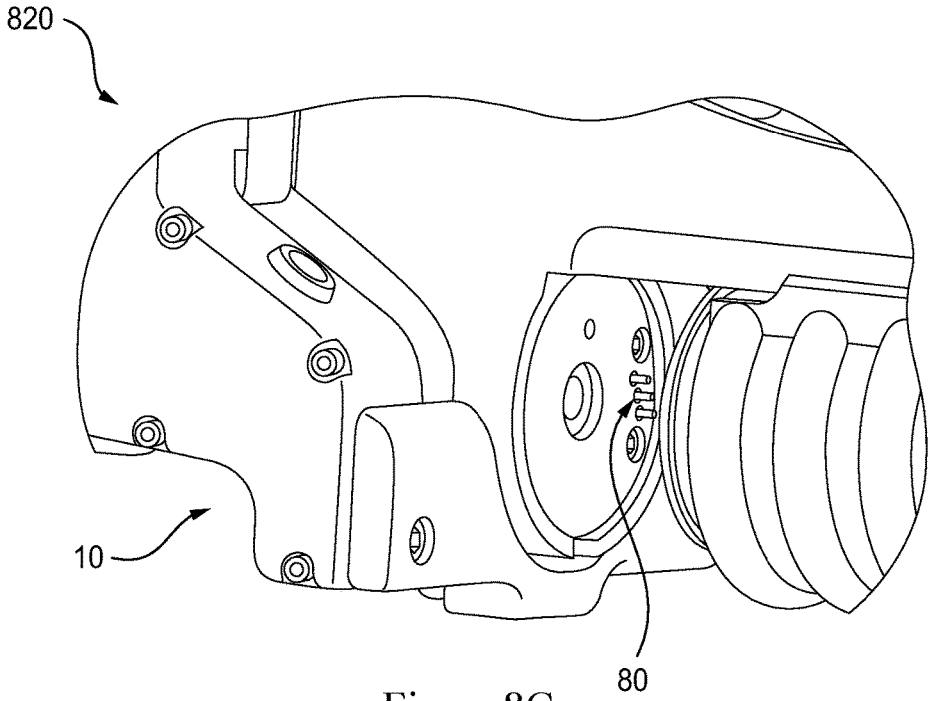

FIG. 8A is front sectional view of the breech of the barrel which receives the base of the cartridge. The base plate of the breech 8 includes a channel 80 or recess which contains spring loaded contact pins 81, 82 and 83 each of which align with one of the concentric contact tracks 35, 36, and 37 so as to establish an electrical connection between the firing control module and the primer interface module of a loaded cartridge. The use of concentric tracks on the cartridge base allows the cartridge to be loaded in any orientation. That is, there is no need to align the pins with the tracks in a specific manner to ensure electrical connection. FIG. 8B is a perspective view of the rear of the cartridge as it is being loaded into the barrel and FIG. 8C is a reverse perspective view illustrating the contact pins located in the channel 80 ready to make contact with the rear of the cartridge.

Figure 10:
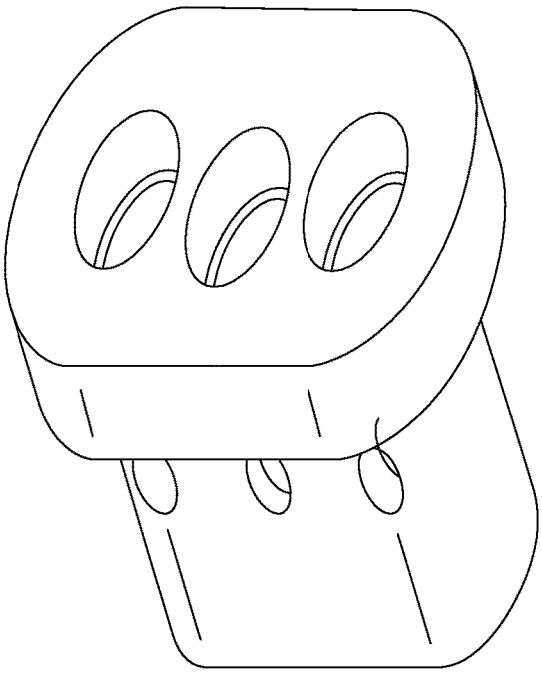
FIG. 10 is a schematic diagram of a polycarbonate pin housing according to an embodiment.
Figure 9:
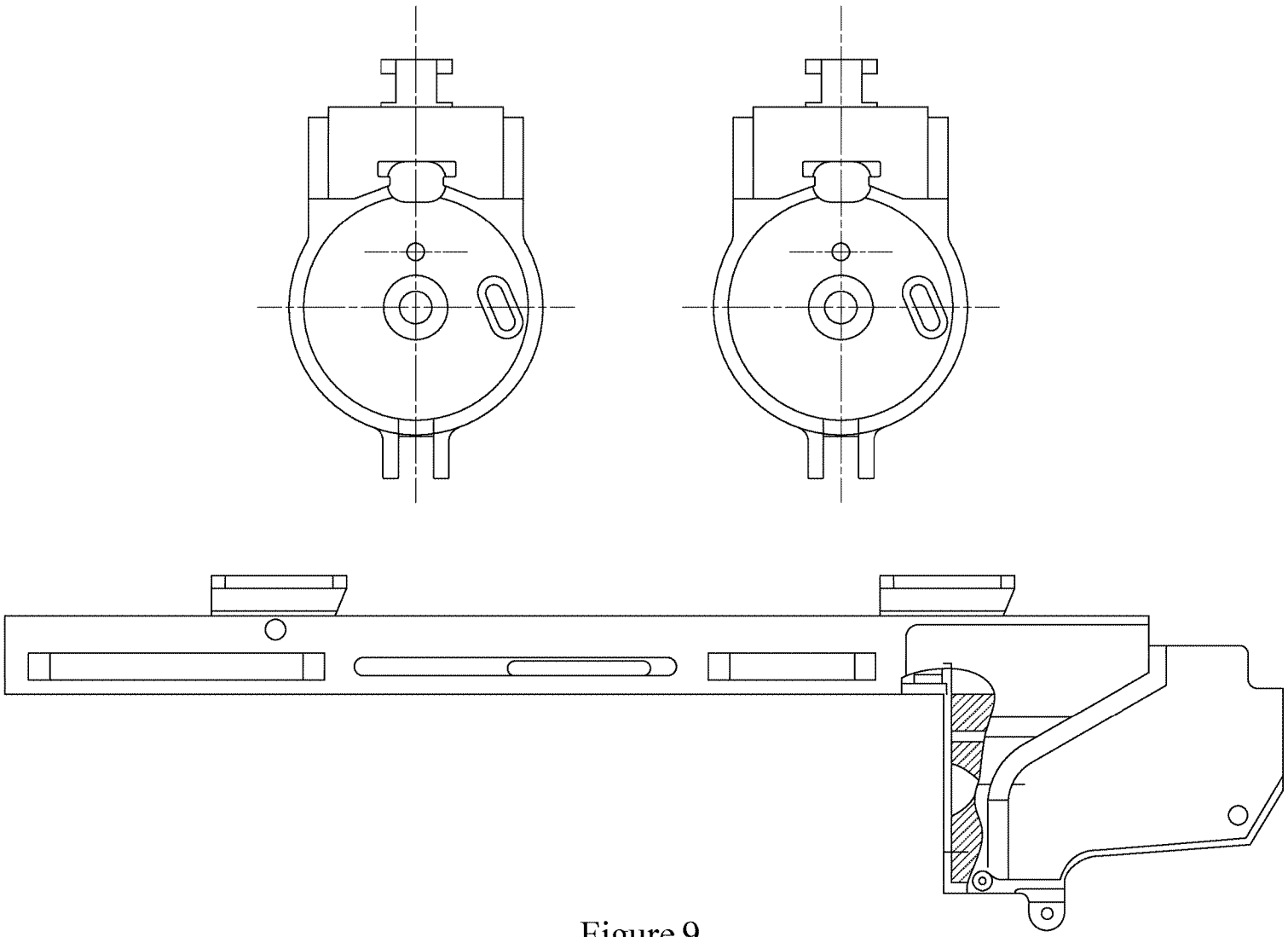
FIG. 9 is a schematic diagram of the M203 chassis and modified base plate in the breech containing a recess for receiving contact pins for firing a cartridge according to an embodiment.
Figure 11:
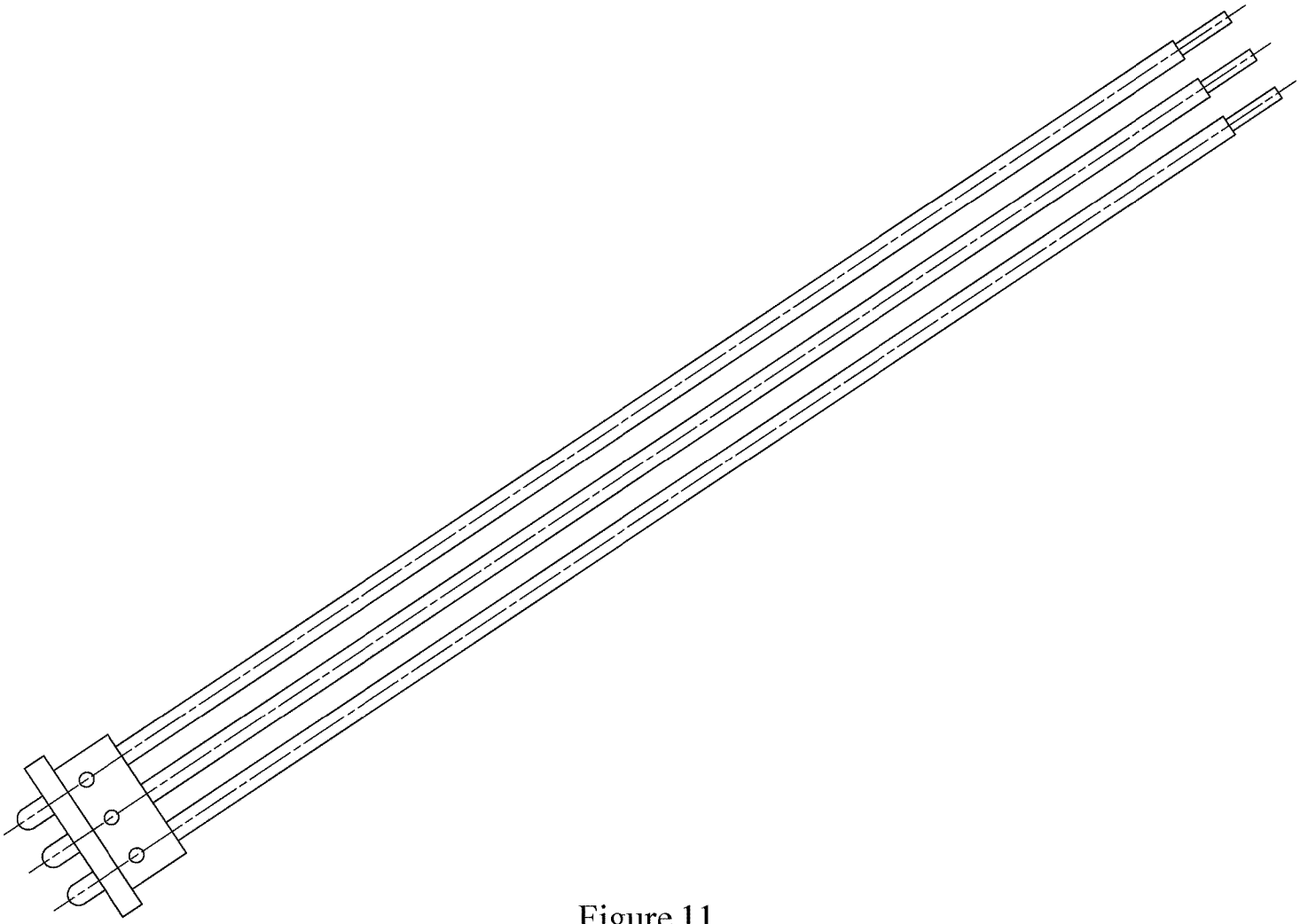
FIG. 11 is a schematic diagram of the contact pins in the polycarbonate pin housing of FIG. 10 ready for insertion into the recess in the modified base plate shown in FIG. 9 according to an embodiment.

FIG. 9 is a schematic diagram of the M203 chassis and modified base plate in the breech which has been modified to accommodate the spring loaded contact pins 81, 82, 83. To allow servicing and replacement of the contact pins (due to wear or corrosion), a slot or channel 80 is provided in the base 8. A polycarbonate pin housing is provided as shown in FIG. 10 which receives the contact pins as illustrated in FIG. 11. The pins are spring mounted in the assembly to bias or force them towards the base of the cartridge. The pin assembly is inserted into the channel 80 and then screwed or otherwise fastened in place.

In an alternative embodiment, a single track is provided on the base of PCB, and a single spring loaded pin is provided in the breech. The PCB further comprises a decoder circuit for decoding a signal sent via the track indicating which of the three propellant chambers are to be fired on receipt of a subsequent firing signal. If primer testing is also implemented, then the primers in the cartridge need to be selected to have resistances within an expected range (ie tighter tolerances are required than in the previous 3 pin case). The single track can be wide to allow for variation in pin location.

In many cases, after firing of the projectile, the cartridge case will still contain unconsumed or unburnt propellant (eg when only one or two out of the three propellant chambers are used). If the case were to be expelled in this state it would represent a safety risk due to the presence of the live propellant in the expelled casing. In order to negate this risk, the fire control unit 7 passes a second delayed firing signal through the initially unselected spring loaded contact pins to initiate the remaining propellant charges so as to render the cartridge safe. The delay is a determined based on the time taken to expel the projectile from the cartridge so that the velocity of the projectile is unaffected by propellant released from the remaining charges.

That is after the selected propellant chambers have been utilized, the remaining unburnt propellant will automatically be ignited. The resulting expanding gases will not adversely affect the velocity of the projectile 60 as it is has already left the cartridge case 50 and travelled a distance down the barrel 5 and thus the cartridge case 50 can safety be ejected from the barrel without any remaining unburnt propellant. Further after firing all the primers and propellant, a primer test can be performed to ensure that all primers are open circuit, and this can be reported back to the user via an indicator such as a status LED. For example a green light after firing can indicate the cartridge is safe to eject and a yellow or red LED (which can be flashing) can indicate that the cartridge contains unused propellant. Other indicators could be used, such an audio indicator (eg sequence of beeps) or other visual indicator.

With the MLGLS system the projectile is typically expelled within about 5 ms of propellant initiation. Thus a delay of at least 5 ms is preferable. Clearly the length of the delay can be much longer such as 10 ms, 30 ms, 100 ms or more. However it is preferable to keep the delay under 1 second to ensure that the user does not attempt to remove the case prior to initiation of the remaining propellant chambers, and/or to allow the user to rapidly reload after firing. Using delays in the tens or hundreds of milliseconds (eg 50 ms, 100 ms, 200 ms) will generally lead to a detectable delay in firings, and thus act as an audible or physical indication that all remaining propellant has been burnt and the casing is safe to expel. As the delay is increased, it may become necessary to recharge the firing capacitor to allow firing of the remaining charges. A delay of approximately 30 ms was selected for the embodiment described below. The delay may be between 1 ms and 1 second or preferably between 10 ms and 100 ms. The delay needs to be sufficient to allow the projectile to be expelled from the cartridge (and travel a sufficient distance from the cartridge) so that initiation of the remaining charges does not generate additional pressure that will substantially alter the exit velocity of the projectile from the weapon. For example the delay will typically be selected to be longer than the time taken for initiation and ejection of the projectile from the cartridge, or longer than the time taken for the projectile to start moving through or along the barrel or for it to exit the barrel. However the exact choice will depend upon several implementation factors such as the cartridge and the weapon system (which determine ballistic characteristics such as internal pressure, and rate of decay), and the electronics used in the fire controller and/or cartridge.

Selection of the propellant chambers to be fired may be manually performed by the manual selector switch which has settings of 1, 2 or 3 for firing 1, 2 or 3 chambers. Alternatively the selector may be set to automatic mode (A) and the laser range finder may be used to automatically select the propellant chambers to be fired. In this case the user aims at the target and presses the firing button. The range finder is activated to obtain an accurate target range, and provides a firing mode signal to the fire control module. Range information is also presented visually to the user, such as a distance measurement and/or a range zone indicator which indicates the number of propellant charges to be fired using the manual selector switch 13 on the fire control module (eg 1, 2 or 3). This enables the kinetic impact energy to be more precisely tailored to the engagement distance, hence less risk of unintended consequences. Further munition trajectories are flatter which increases the delivery accuracy, which is a key requirement for any non lethal munition capability. The range finder can be independently operated by pressing button 11 in which case the range and firing mode to use will be visually reported to the user.

The firing mode signal may be a signal indicating how many of the primers/chambers to be fired, a digital level corresponding to a range zone (eg 0=0-5 m 1=5-20 m, 2=20-50 m etc) or an estimate of the range. Determination of how many and/or which propellant chambers to be initiated may be performed by either the range finder or the fire control module. In the case of equal sized propellant chambers, only the number of propellant chambers to be initiated needs to be determined. However if variable size propellant chambers are used, then a wider range of velocities are possible, as the different propellant chambers can be combinatorially combined to provide finer control over the output velocity, and thus the force delivered to the target. For example 3 different sized propellant chambers may be combined in 7 different ways to produce 7 different velocities or range zones. By appropriate choice of propellant charges the range zones may be regular increments (eg 50 m range zones, to cover 0-350 m) or the range zones may be irregular with finer divisions for the short ranges (ie <100 m) where non lethal weapons are typically used. For example the sub 100 m could be divided into 4 or 5 range zones, with much larger range zones being used beyond 100 m (eg 0-10 m, 10-30 m, 30-60 m, 60-80 m, 80-120 m, 120 m-200 m, 200-300 m, 300 m+). In this case the primer interface module may include a cartridge identifier (eg a unique code) to allow a firing controller to determine the type of the cartridge (eg using a code which can be looked up in a memory in the fire controller). This information can then be used by the firing controller to select which primers and propellant charges to be initiated.

The fire control unit may be provided with a further interface to indicate the type of cartridge (eg non lethal projectile 20 or 3 shot shotgun cartridge 520) loaded in the weapon so that appropriate ballistics characteristics can be taken into account (eg weight, shape, propellant, equal propellant chambers etc). Alternatively this could be stored in the PCB circuit contained with the cartridge, and the cartridge could be interrogated and this information provided to the range finder. This then allows the weapon to accommodate many different cartridges and projectiles (eg electrical, flare, etc) thus allowing it to be used in many different scenarios.

Numerous variations are possible, and may be implemented using a combination of a fire control apparatus and a cartridge. In some embodiments selection is performed within the fire control apparatus and firing signals are communicated to individual primers in a cartridge via separate or dedicated electrical paths for each primer in the cartridge. In other embodiments an encoded signal may be sent to the cartridge which decodes the signals and selects or enables the appropriate primers so they may be fired by a subsequent firing signal. The fire controller may delay a second firing signal to initiate the remaining primers. In another embodiment a single firing charge may be sent to the cartridge, and a primer interface module (eg circuit board) within the cartridge may generate the delay and second firing signal. The primer interface module may store a portion of the firing charge, and then use the stored portion to initiate the remaining primers after a first delay. In another embodiment the primer interface may contain a power source such as a battery, and this may be used to generate a signal to initiate the primers. The power source may be a rechargeable battery (or charge storage device) which is charged by the fire controller when the cartridge is inserted into the barrel of a weapon.

In one embodiment, the firing controller may initiate the selected primers in sequence with each subsequent primer (after the first) initiated a predefined primer initiation delay after the previous primer, rather than synchronously initiating the primers. This may be useful in accelerating heavy projectiles, in which a sustained pressure impulse can be used to more effectively launch the projectile. For example if two propellant chambers were selected, the first primer could be initiated, and after a delay (primer initiation delay) of 1 ms, the second primer could be initiated. That is rather than generate a large pressure spike which can rapidly decay after the projectile begins to leave the casing, a pressure pulse with a lower amplitude but longer duration can be generated. This can be used to more efficiently and uniformly accelerate a heavy projectile. The primer initiation delay (or delays) will depend upon the specifics of the cartridge and projectile. The delay before firing a subsequent selected primer may be selected to correspond to the point in time when pressure begins to drop after initiation of the previous primer below some threshold level. The primer initiation delay may be in the range of 100 microseconds, 500 microseconds, 1 ms, 2 ms, 3 ms, or some other value. If more than 2 primers are selected, the delays between primers may be constant or they may be varied.

A detailed description of an embodiment of a fire control module forming part of the MLGLS will now be described with reference to FIGS. 12 to 20, which show the fire control module, appropriate circuits and timing diagrams. It will be understood that his is one example embodiment, and other variations are possible. Functionally the operation of the fire control module is as follows. On initially switching on, the power systems are initiated, the microcontroller is initiated, and the primer address counter reset. Next the counter is stepped through 000, 001, 010, 011, 100. Each time this count results in address of a single primer, a primer test is performed. If all primers are correct (positive test result), the LED flashes red to indicate the weapon has a live cartridge and is potentially fireable. For simplicity we will assume a manual fire mode is selected. On pressing the fire button, another count and primer test sequence is performed—if one of the primers fail, the LED flashes yellow, and the sequence terminates (ie firing aborted). If the test passes, the counter resets and is incremented to the required level, and the selected primers fired (FIRE 1). After 30 mS the counter is incremented to its terminal count (111) and FIRE 2 is activated, clearing all unfired primers. The counter is then reset and a final primer check performed. If all primers are seen to be open circuit, the LED flashes green indicating a fully fired, safe to discard cartridge. If any primer does not measure open circuit, the LED flashes yellow, indicating a possible hazard. The 2 fire circuits are used as it is not possible to recharge a single circuit within the 30 mS time period. The operation is similar in auto mode, except that the laser range finder determines the fire level mode and communicates this information to the microcontroller in the fire control module. The firing capacitors are discharged and the single pin line grounded when the weapon is switched off.

This system has been designed for use with either a single pin or 3 pin connector, with 3 pin connector being preferred as more robust primer testing can be implemented with standard primers, which have typical resistances of between 150 ohms to several K ohms. If single pin mode is selected, then primers must be selected with consistent resistances such as 1K+/−30% to ensure accurate primer testing is performed. This is because combinations of primers are required to verify primer functionality, and if they vary excessively the difference between 2 and 3 primers can be difficult to determine. This circuit could be simplified for use with only the three pin case.

Figure 12:
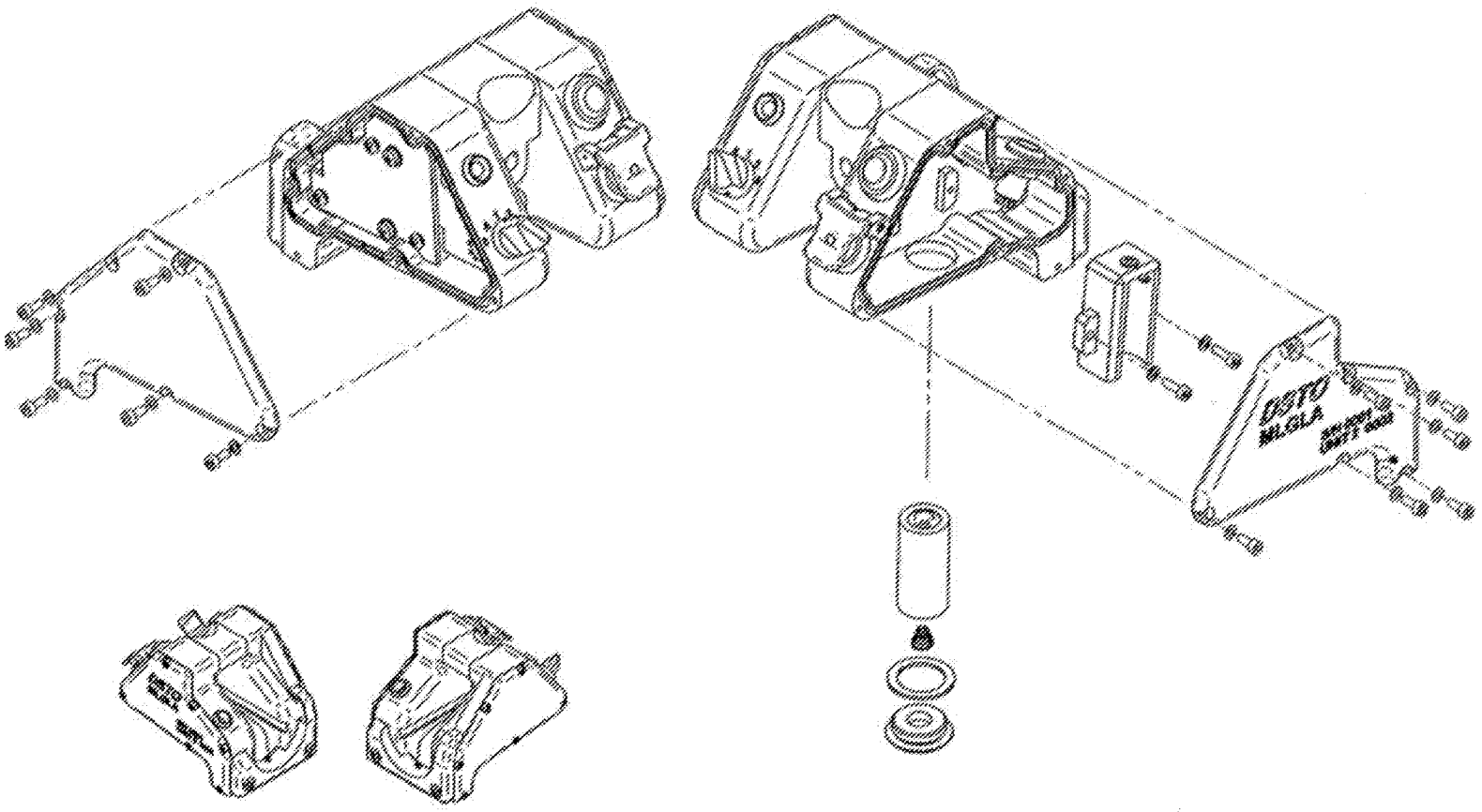
FIG. 12 is an exploded schematic diagram of the fire control module according to an embodiment.
Figure 13:
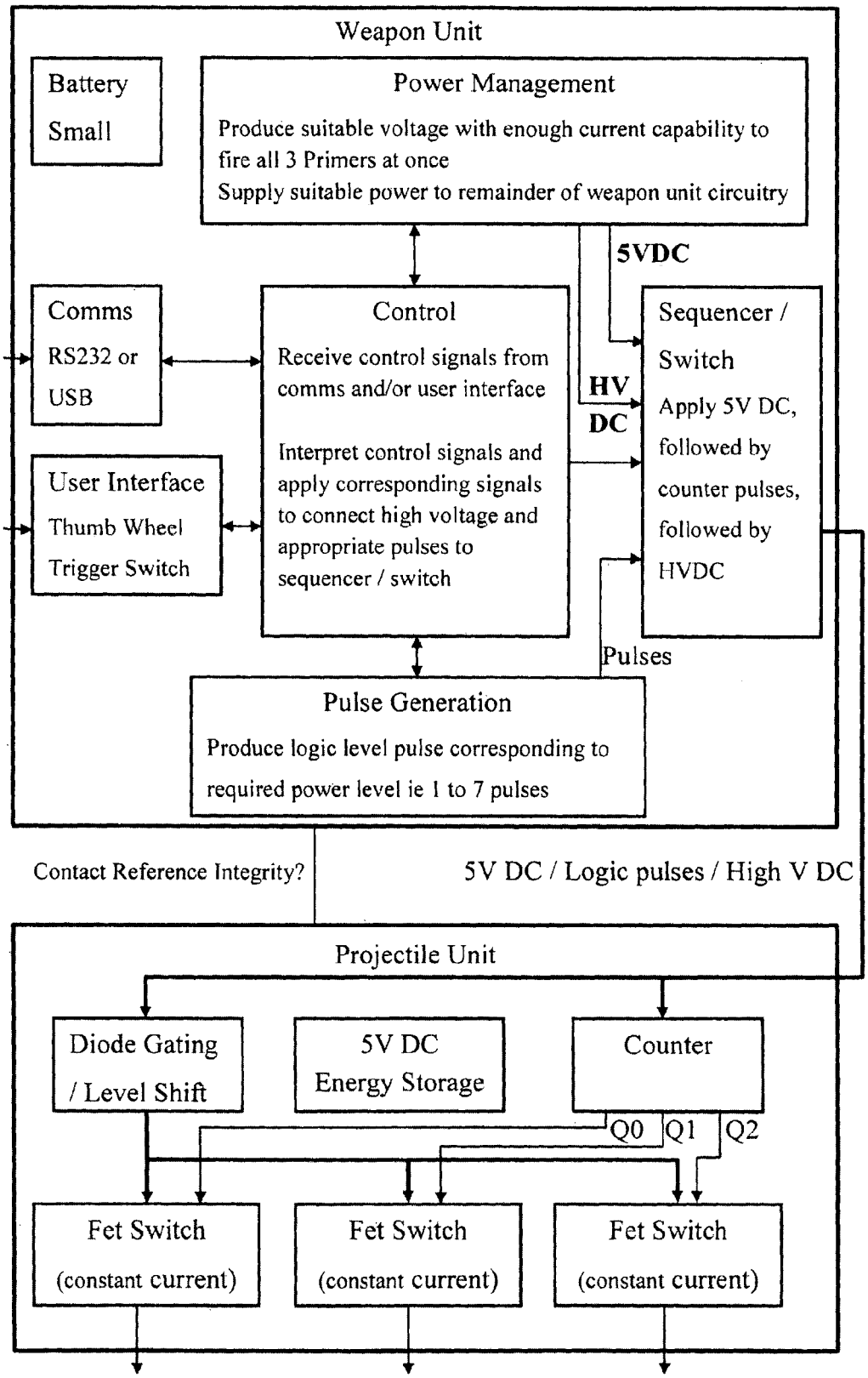
FIG. 13 is a block diagram of the fire control module and primer interface module according to an embodiment.
Figure 14:
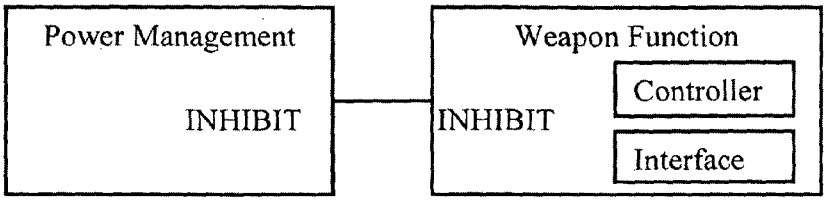
FIG. 14 is a block diagram of the power management and weapon function modules in the fire control module according to an embodiment.

FIG. 12 is an exploded schematic diagram of the fire control module and FIG. 13 is a block functional diagram of the fire control module and primer interface module for the single pin case. For the 3 pin case, the functionality of the primer interface module can be provided on the fire control module, and the primer interface module within the cartridge is kept as simple as possible, essentially only containing direct connections to the primer, as will be discussed. As shown in FIG. 12, the fire control module includes a battery compartment for receiving a battery, and further includes 3 printed circuit boards (PCBs) comprising a power management board, a microcontroller board and a cartridge interface board which together provide weapon function as illustrated in FIG. 14. The fire control module may be constructed of aluminium and sealed to prevent ingress of moisture or dust. The functional blocks in FIG. 13 will now be described.

The microcontroller or logic controller determines which charge to fire based on manual switch selection or data from the laser range finder when in auto mode, by incrementing a counter as described below. A Fire 1 signal is used to fire the selected charges, and a fire 2 signal clears any unused charges after about a 30 mS delay i.e. the projectile is long gone and not influenced. This is to ensure that spent cartridges are totally inert. After firing the microcontroller does a final primer check to verify this, and expects to find 3 open circuit primers—if OK the status LED blinks green, if not it blinks amber to warn of a possible hazard.

Figure 15A:
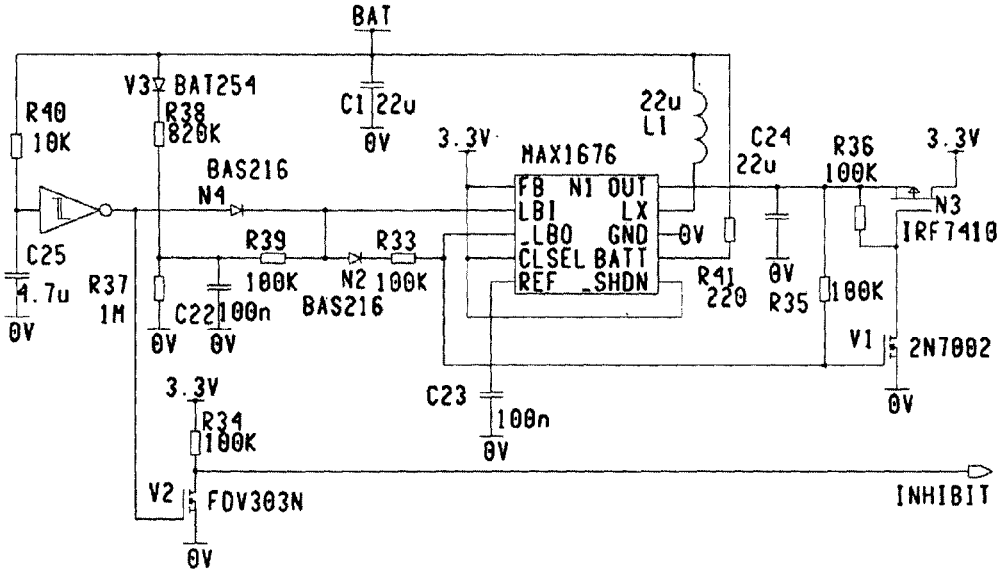
FIG. 15A is a circuit diagram of the power management PCB in the fire control module according to an embodiment.
Figure 15B:
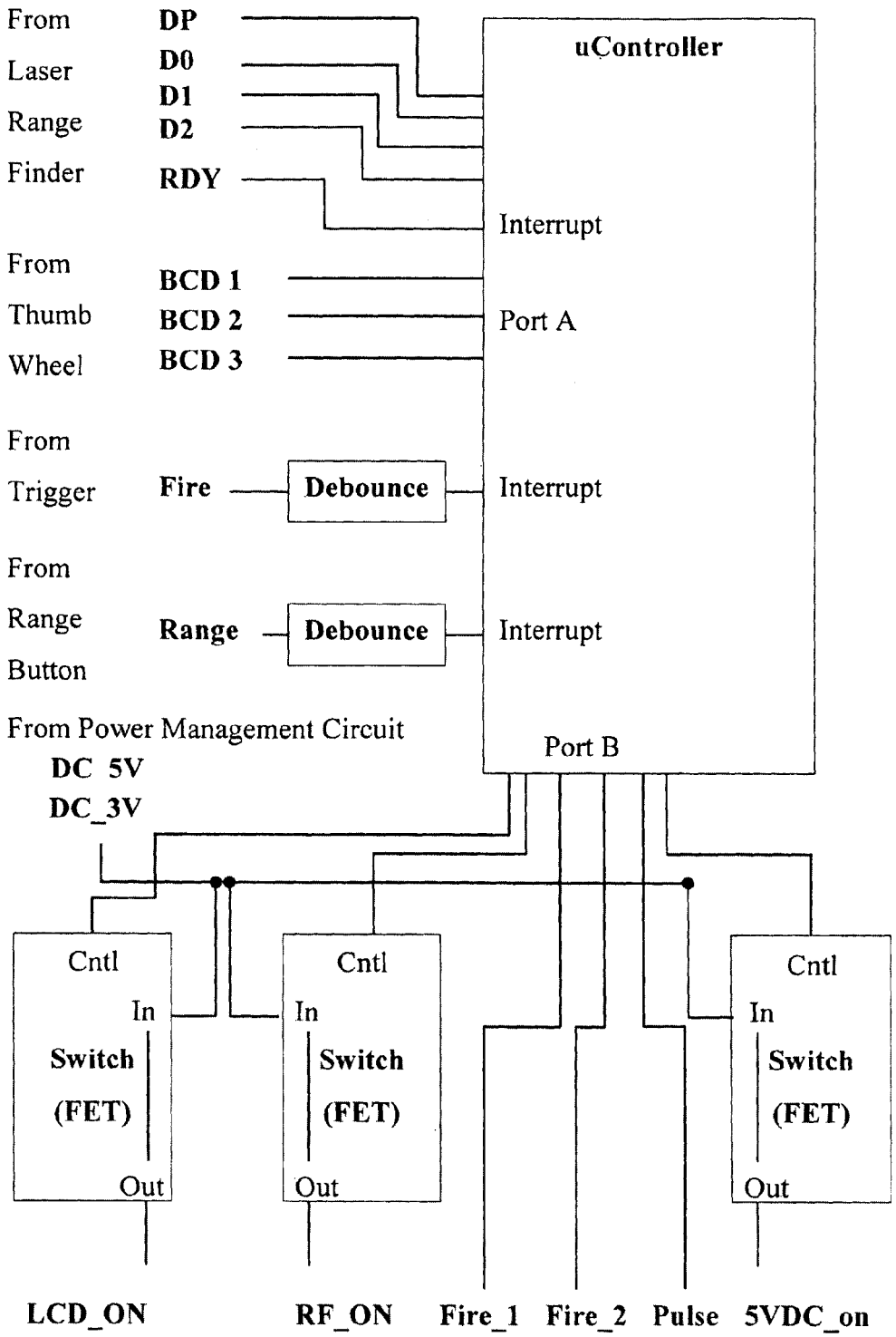
FIG. 15B is a schematic diagram indicating the inputs and outputs to the microcontroller in the fire control module according to an embodiment.
Figure 15C:
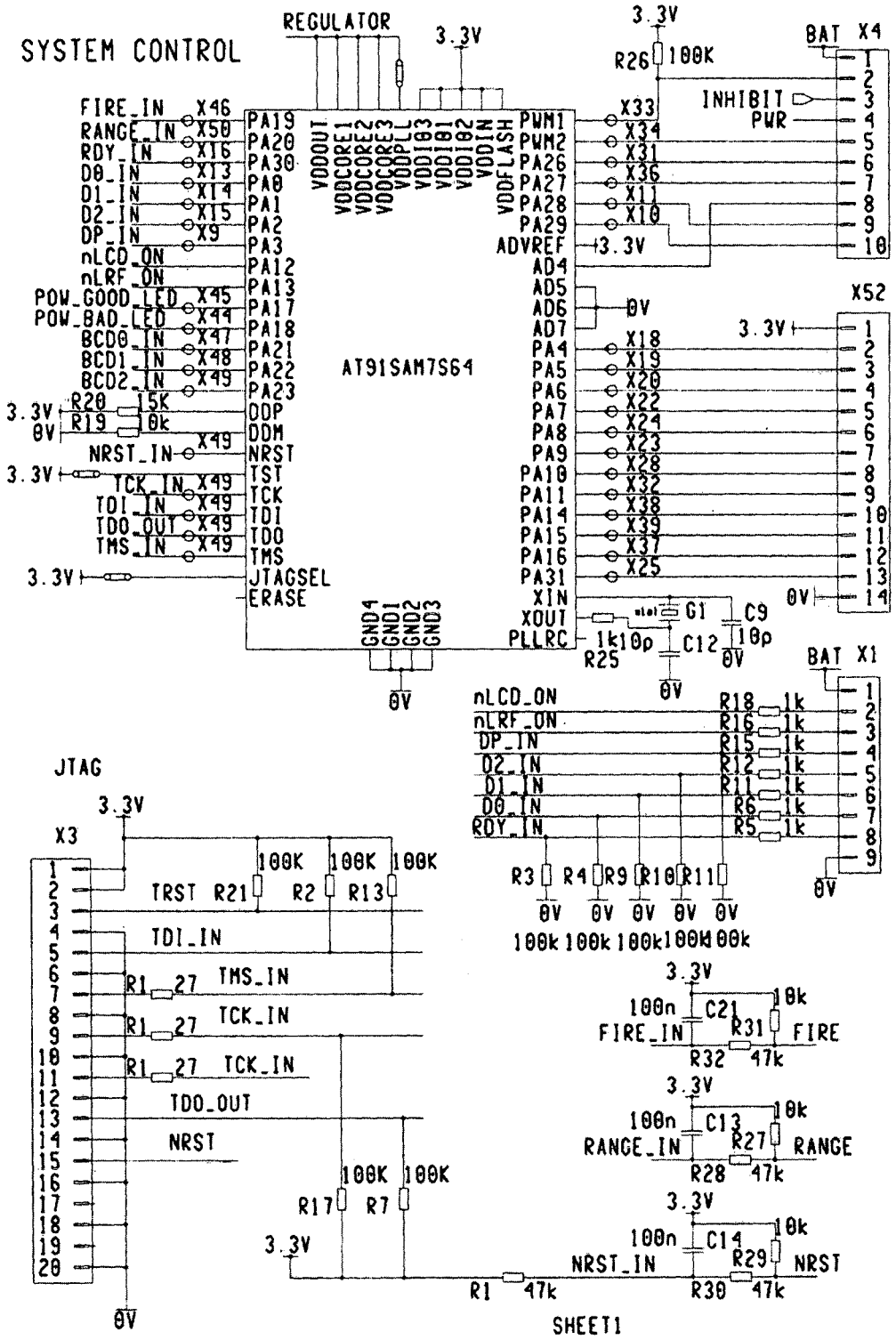
FIGS. 15CA and 15CB are a circuit diagram of the microcontroller in the fire control module according to an embodiment.
Figure 15C:
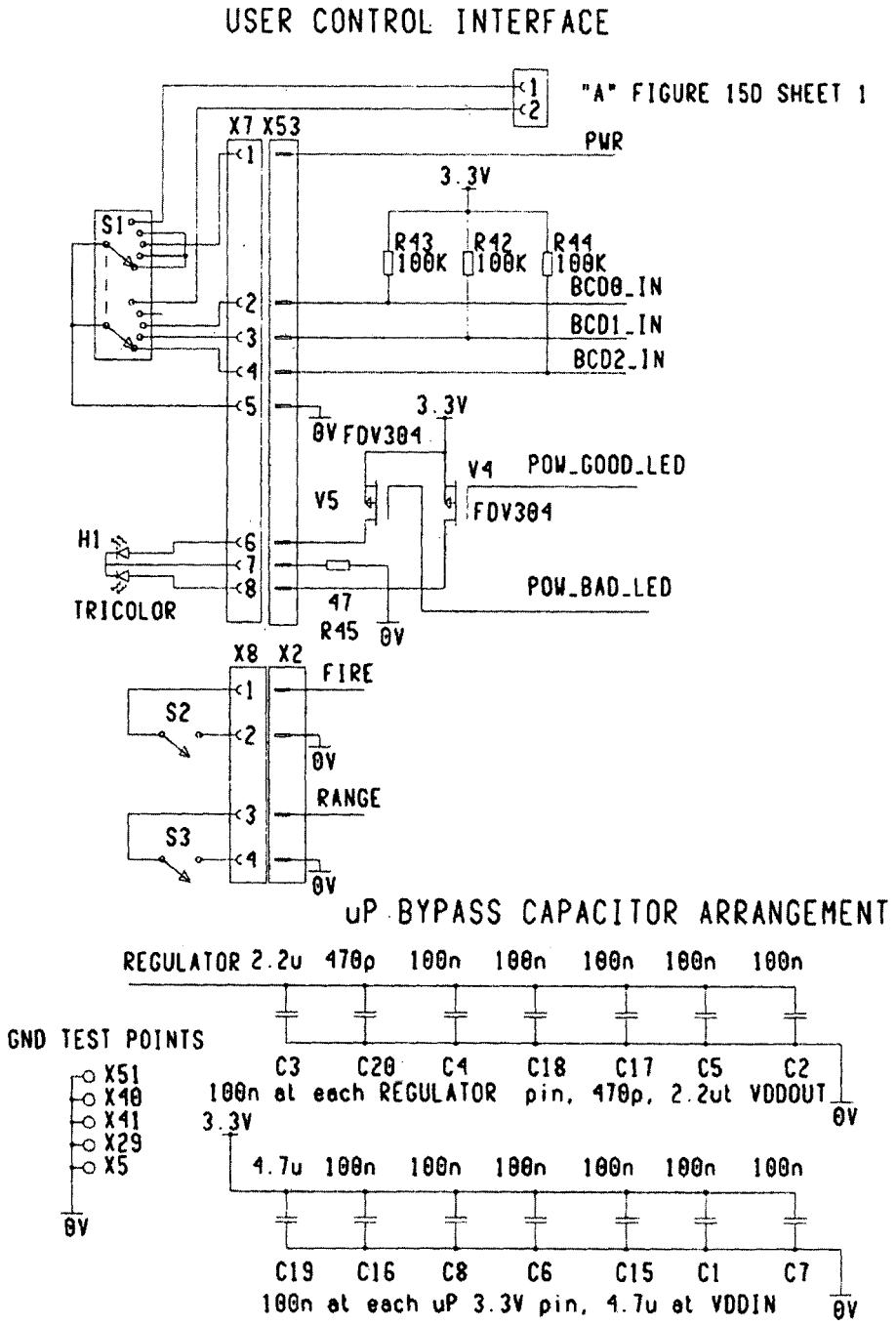
Figure 15D:
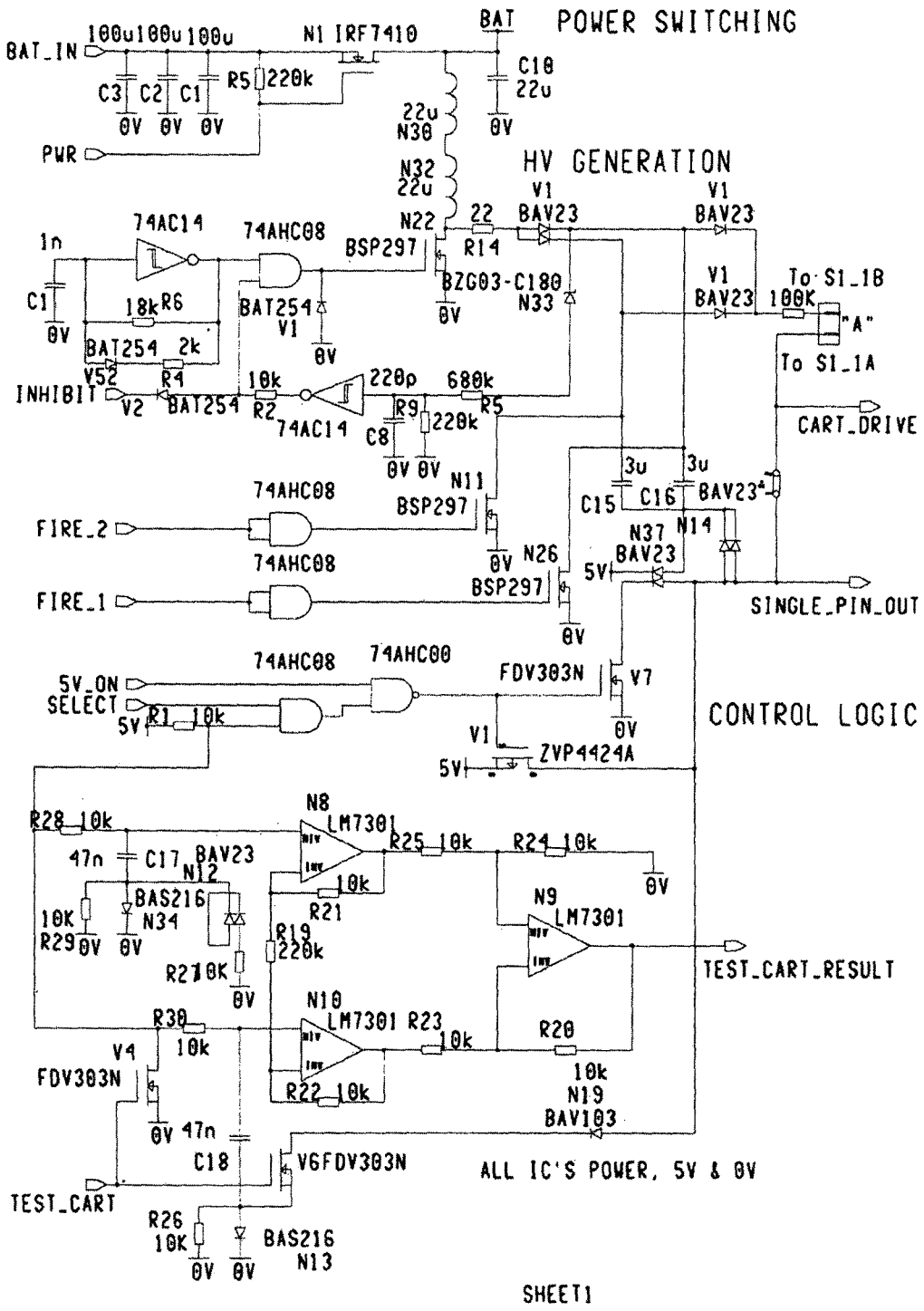
FIGS. 15DA and 15DB are a circuit diagram of a cartridge interface circuit in the fire control module according to an embodiment.
Figure 15D:
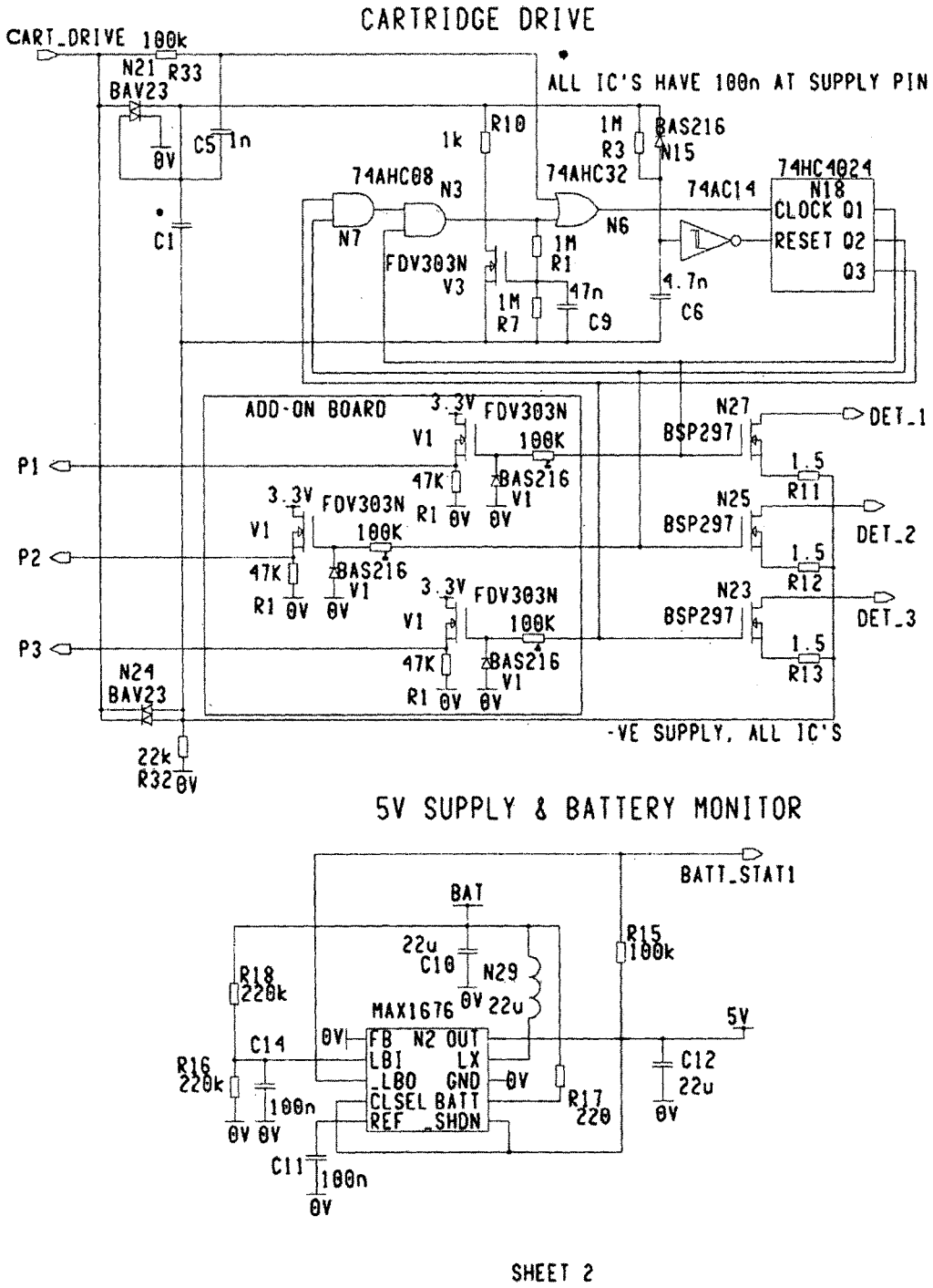

FIG. 15B illustrates the various input and outputs to a microcontroller on the microcontroller board. FIG. 15C is circuit diagram of the microcontroller in the fire control unit, featuring an AT91SAM7S64 logic controller. This controls the counter drive, primer test pulse timing and reading, fire 1 and fire 2 timing, status LED drive and various other housekeeping functions. External inputs are auto/manual/fire level (main rotary control), manual fire button and the interface to the laser range finder as illustrated in FIG. 15B. The laser range finder selects the fire level based on the measured range compared against stored reference levels. The unit is totally useable in manual mode without any connection to the laser range finder. Note that most of the logic of the system is contained in the microcontroller. From a design point of view this was to use the least possible circuitry in the cartridge, as due to the presence of primers and propellant in the cartridge it is desirable that the cartridge be as passive as possible and not store any energy in the cartridge capable of initiating the primer firing. Controller operation and timing is discussed in more detail below.

Figure 15E:
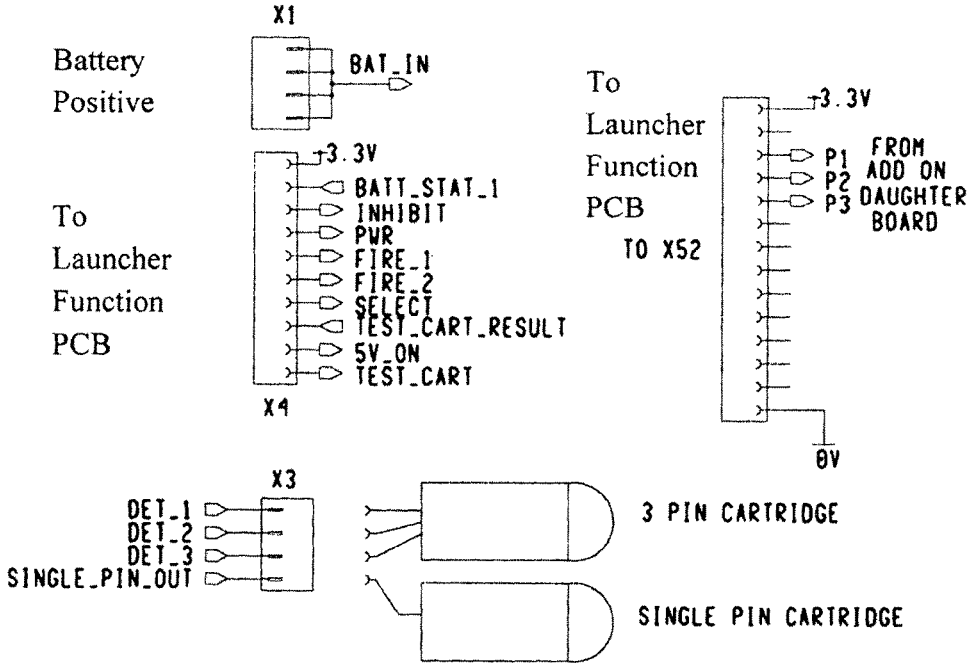
FIG. 15E is a circuit diagram of the connectors in the fire control module according to an embodiment.
Figure 15F:
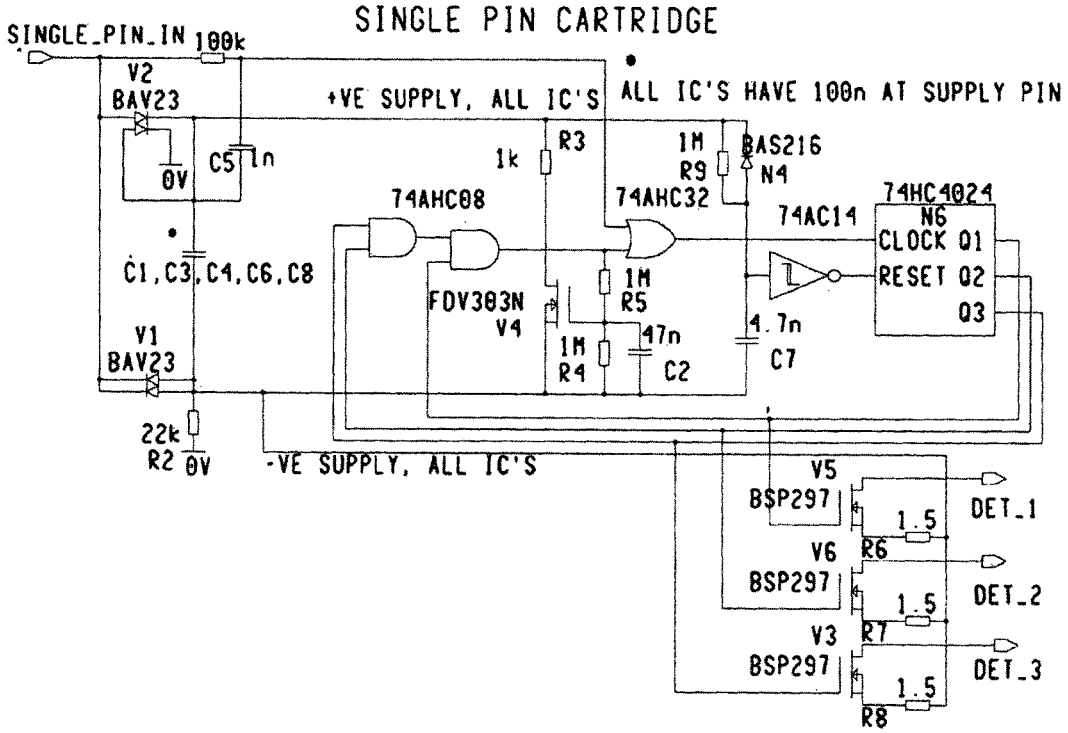
FIG. 15F is a circuit diagram of a decoding circuit in the primer interface module for a single pin cartridge according to an embodiment.

The power control board includes a 180V high voltage generator and energy storage capacitors (eg 1 microFarad or 3 microFarad), power to the laser range finder and the logic to manage and distribute the various control signals from the microcontroller. Connectors are shown in FIG. 15E. These are: 5V_ON—supply voltage to cartridge circuitry; SELECT—200 uS pulses to increment the fire selection counter; TEST_CART—30 uS pulses to provide primer test pulses; TEST_CART_RESULT—an analogue voltage pulse proportionate to primer resistance, generated in response to the TEST_CART pulse; INHIBIT—to inhibit high voltage generator operation under some conditions; FIRE_1—400 uS pulse fires selected primers; FIRE_2—400 uS pulse fires any remaining primers. As shown in FIG. 14 the power management board provides an INHIBIT signal to the microcontroller (on the microcontroller board) to inhibit weapon function, by preventing high voltage generation.

It is desirable that the system can run for approximately 10 hours and provide power for several hundred firings on a single battery (or between battery recharges). A suitable battery is a 3V lithium types CR123A battery (1600 mAH) which can be easily boosted to 5V and can provide high voltage generation. This can also be used to power the laser range finder which will draw about 1 W for several seconds as well as power the FPGA. A battery compartment with capacity for two batteries could be added to extend battery life further.

FIG. 15A is a circuit diagram of the power management PCB in the fire control unit. A 5V/3.3V supply can be generated by a MAX 1676 monolithic converter. The chips are programmed for either 3.3 or 5V output by strapping the FB pin to either the output or GND. Current capability is over 0.5 A and light load efficiency is extremely good. The chips have an inbuilt reference and comparator which are used for low battery detection.

A start up inhibit functionality is provided. The system processor takes some time (approx 20 mS) to initialise, during which time many of its outputs are pulled high. To prevent unwanted system activity and extra battery load during the initial start up, the high voltage generator, and power feeds to the LRF and LCD are inhibited for about 50 mS. This is done with an RC network feeding a Schmidt trigger inverter. This produces reliable time delays, independent of battery voltage. A small FET is used to pull the inhibit line low during this period. The inhibit timer is also used to hold the battery cutoff comparator in reset during this period, avoiding possible false trips due to the initial heavy load on the battery.

Battery monitoring is also performed. The comparator in the 5V supply generator is used to provide early warning of battery failure. An active low signal is generated on BATT_STAT1 when the battery falls to 2.6V. This is applied to the LED indicator, after processing to produce red flashing instead of green flashing. There is little filtering and no hysteresis, so the LED may give some red flashes on heavy battery loads as the trip point is approached. A low battery cut off is implemented and a comparator in the 3.3V generator cuts off the system, by disabling the 3.3V supply, when the battery is too low to ensure reliable operation. The input to the comparator is filtered and conditioned to prevent trips on glitches. A large amount of hysteresis is applied, so that when a trip occurs, there is a latching action, and no recovery. A FET switch cuts off the 3.3V supply, effectively disabling the whole weapon.

A high voltage generator is used to produce high voltage pulses for initiating the primers. Suitable primers are Remington electrical primers which can be fired at levels between 60-300V. The nominal specified level is 160V and an 180V generator was used. On application of a valid firing voltage, the resistance in the primer ramps down, with the current rapidly ramping up to the current limit of the firing circuit. Reliable firing was achieved at current levels of <0.5 A. The device will detonate typically in about 5 micro seconds. During this time the device will have a voltage drop of about 40V, almost independent of current. Some devices are permanently electrically shorted at the end of the firing cycle. To provide a good margin for sub specification devices, it is desirable to allow 1 A current for 10 uS and an initial voltage of 200V. A storage capacitors with either 1 microFarad or 3 microFarads was selected for use. A pair of unused poles on the rotary on/off/function switch was used to discharge the firing capacitors completely and ground the single pin line when the weapon is switched off. To discharge this capacitor into the load, a FET switch able to handle 200V and 1 Å current pulse is required. To enable drive from 5V logic it must be a low threshold device. A suitable device is an Eline through hole series (ZVN4424A). A constant current can easily be generated by driving the gate with 5V and selecting a suitable source resistor to ground. With Vgs of 3V, this is approximately 2 ohms.

A suitable high voltage generator is a boost converter fabricated from discrete components. Operating frequency is about 50 kHz, generated from a Schmidt trigger oscillator. Duty cycle is about 80%. The FET is switched on during the "on" period, ramping current up in the inductor. During the off period, a flyback pulse is generated, with the energy delivered by the diode to the storage capacitors. Recharge time from a cold start is about 300 mS. When the terminal voltage (about 200V) is reached, the FET gate drive is switched off by the Zener/Schmitt trigger inverter/"and" gate combination. This is effectively a zero power shutdown. Due to the Schmitt trigger hysteresis, the 200V supply needs to drop about 5V before switching resumes. About 10 mS is needed to recharge. Recharging will occur about every 5 seconds. With separate lines for three primers the HV output can be rectified by 3 diodes each feeding a separate energy storage capacitor for each channel. For a single line version a single large capacitor is used as all three primers will need to be fed through the single contact pin line (eg 1 uF or 3 uF).

The user interface includes a trigger, thumb wheel/switch selector, range button and LED. A trigger button is provided to fire the weapon at an automatically or manually set lethality setting. If no lethality setting has yet been set in automatic mode by use of the range button, the minimum lethality level is set (ie one propellant charge). A thumb wheel or BCD switch is provided to allow for selection of different primer combinations. Up to 8 levels (0-7) can be provided with the thumb wheel to allow use with rounds of varying propellant charge sizes. Higher level values (8, 9) can be used to designate an off state. A "0" level can designate auto (ie via range finder) and levels 1, 2 and 3 can correspond to firing of 1, 2 or 3 charges in if equal sized propellant chambers are used. Otherwise levels 1-7 can represent different combinations of 1, 2 or 3 propellants chambers. The thumb wheel or switch can also function as the power on button. The range button sets the lethality setting as obtained from the Laser Range Finder. The laser range finder detects the range when button is pressed and outputs a lethality setting to the fire control module. An LCD reading of the range is provided by the Laser Range Finder.

A dual LED will be used with one red and one green LED to provide power indication. The green LED indicates a charged battery. The red LED indicates a flat battery. When the red and green LEDs are both off, this indicates a condition where power has been removed from the circuit to avoid unpredictable operation due to the diminished battery. When the red and green LEDs are both on, this indicates a "Bad Primer" condition. To conserve power when on, the LEDs will be flashed at a duty cycle where, to the human eye, the LEDs will appear to be constantly on. After firing a green LED indicates the casing is safe to expel, and a flashing yellow indicates the casing is hazardous (possibly unburned propellant).

The Fire and Range input switches are each connected by a cable and connectors from the exterior shell to the PCB. One of the NRST inputs is a small button connected directly to the PCB to facilitate resetting the circuitry during programming of the micro controller device. All three buttons are connected to debounce circuitry, with RC time constants of approximately 4.7 ms, to avoid multiple triggering of the micro controller inputs (see FIG. 15B). The NRST signal may also be asserted low by the microcontroller, and for this reason a 1 k current limiting resistor is connected between the micro controller NRST 10 and the associated debounce circuitry. The micro controller NRST IO is also connected directly to the JTAG port enabling resetting of the micro controller through the JTAG port.

The INHIBIT input, when grounded, forces a ground on the 5V_ON output and turns off the LRF_SVDC_OUT output to prevent spurious signals affecting the state of the system during start up. Once start-up is complete, the INHIBIT is raised to 5V, reverse biasing the diodes and enabling the outputs.

The connector connects to a cable which connects to the Laser Range Finder module. The signals or power supplied on each pin are described below:

LCD_RESET_OUT: When asserted, resets the laser range finder's LCD to the off state if the LCD is on;

LCD_POWER_OUT: Provides power to LCD on laser range finder when required;

LRF_5 VDC_OUT: Provides battery power to laser range finder when required;

DO_IN-D2_IN: Provide lethality setting when in auto mode;

DP_IN: Parity bit for DO_IN-D2_IN;

RDY_IN: Triggers latching of current values of lethality data and parity bits.

The micro controller interfaces will now be discussed. FIRE(_IN), RDY_IN, and RANGE(_IN) are connected to the three external interrupt inputs of the micro controller as these signals trigger critical events. Interrupt response time is effectively instantaneous as it consists of the time it takes to enable the processor and perform the interrupt service routine. Estimating this takes 100 cpu instructions (300 clock cycles), this would constitute a period of 300*250 ns 75 us. Relative to the millisecond time scale required for the cartridge, this period becomes insignificant. FIRE_1, FIRE_2 and SELECT are timer outputs of the micro controller to suit the timed nature of these signals. 5V_ON is also a timed signal but uses a general purpose IO as there are only three useable timer outputs.

The trigger sequence is initiated by the FIRE interrupt and is as follows:

1) Disable interrupts and, if LCD_ON is asserted, assert LCD_RESET_OUT then de-assert LCD_ON.
2) Carry out primer test, continue if successful, otherwise indicate fail on LEDs, re-enable interrupts, and abort firing process.
3) If a manual range has been chosen on BCD switch then skip to step 9. For automatic range, continue.
4) Assert RF_ON and LCD_ON and then LCD_RESET_OUT upon pressing of FIRE button.
5) Wait for rising edge on READY input.
6) Latch D0-D2 and DP upon rising edge of READY input.
7) De-assert RF_ON.
8) Check Parity of data and if data invalid, replace data with minimum lethality data.
9) Turn on the 5 VDC output for a predetermined period;
10) Pulse an active low count within the range of 1 to 3 on the PULSE output (which is set normally high from power on reset) depending on FP signals. Turn off the 5 VDC 0/P during low of last PULSE output;
11) Pulse output FIRE_1 for a predetermined period;
12) Wait a predetermined period after pulsing FIRE_1 output;
13) Pulse output FIRE_2 for a predetermined period;
14) Wait a predetermined period after pulsing FIRE_2 before accepting another input from FIRE FP (This facilitates the recharging of the high voltage generator in the power circuitry);
15) Carry out a primer test for open circuit, and alert the user of the status (Green for safe to expel; flashing yellow for possible hazard)
16) Re-enable interrupts.
16) Upon receiving another initiation pulse on FIRE I/P, repeat the above sequence.
17) Assert LCD_RESET_OUT and then de-assert LCD_ON 30 seconds after depressing the RANGE button (if not already de-asserted due to an interrupt)

The ranging process is initiated by the RANGE interrupt and is as follows:

1) Disable interrupts and, if LCD_ON is asserted, assert LCD_RESET_OUT, then de-assert LCD ON.
2) Carry out primer test, indicate fail on LEDs.
3) Assert RF_ON and LCD_ON, and the LCD_RESET_OUT upon pressing of RANGE button.
4) Wait for rising edge on READY input.
5) Latch D0-D2 and DP upon rising edge of READY input.
6) De-assert RF_ON.
7) Check Parity of data and if data invalid, replace data with minimum lethality data.
8) Re-enable interrupts.
9) Upon receiving another initiation pulse on RANGE I/P, repeat the above sequence.
10) Assert LCD_RESET_OUT and then de-assert LCD_ON 30 seconds after depressing the RANGE button (if not already deasserted due to an interrupt).

A primer test for used/faulty primer sensing is performed as followed:

1) Disable interrupts if not already disabled.
2) Turn on 5 VDC and TEST_CART.
3) A predetermined time later, turn off 5 VDC.
4) A predetermined time later, capture and store input TEST_CART_RESULT.
5) A predetermined time later turn off TEST_CART_RESULT.
6) Indicate any failures by turning both LEDs on.
7) Re-enable interrupts.

Approximate timings are 6 ms for primer test, 100 ms for range acquisition and 30 ms for firing sequence, or 136 ms in total. The HV generator takes a further 300 ms to recharge (ie total cycle time of 436 ms).

The Sequence/Switch module applies 5 VDC followed by counter pulses to test and select primers, followed by HVDC to fire the selected primers. A pulse generation module produces logic level pulses corresponding to the required power levels (eg 1 to 7 pulses). Either a one pin or three pin connector is used to electrically connect the cartridge to the fire control module. For the three pin case, this circuitry is provided on the cartridge interface PCB shown in FIG. 15D. If a single pin connector is used, then a decoding/primer selection circuit is required on the primer interface module as shown in FIG. 15E. This effectively replicates the circuit shown in the top left of FIG. 15D. Either a three or 1 pin configuration can be selected by changing the pin assembly and fitting or removing X2 jumper in FIG. 15D. Signals through the pin contact(s) provide the following functionality. They enable testing of primers for continuity; determine the number of charges to fire; fire the charges; and after a short delay fire any remaining unused charges.

Figure 16:
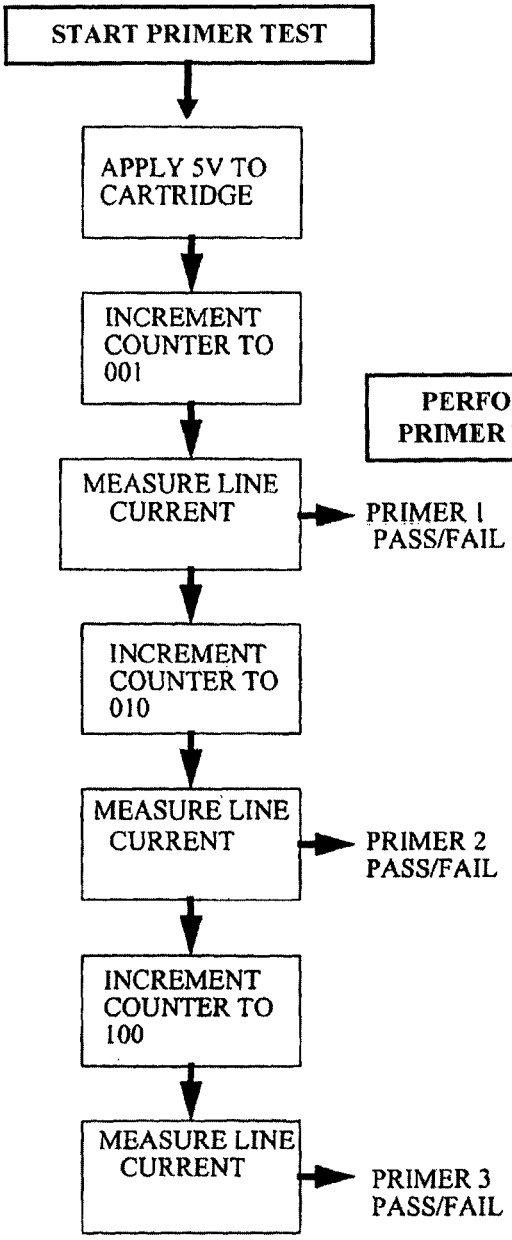
FIG. 16 is a flow chart of the primer testing process according to an embodiment.
Figure 18:
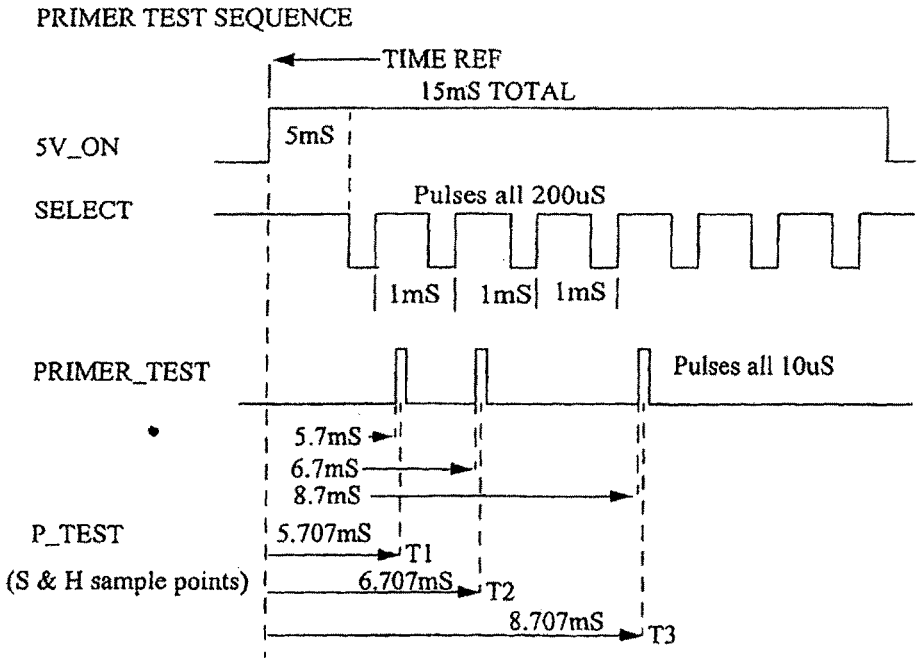
FIG. 18 is a diagram illustrating the logic signals and associated timing for performing a primer test for a cartridge with unfired primers according to an embodiment

A primer test is done on loading of a cartridge, before a firing sequence to test for unfired and valid primers, and after firing to test for open circuit primers (ie safe cartridge), or at any other suitable time. It is only practical to test for open circuit, due to the restrictive safe test current of 5-15 uA at a maximum of 1.6V. The test process is illustrated in FIG. 16, and FIG. 18 is a diagram illustrating the logic signals and associated timing for performing a primer test. Primer testing is performed by turning the 5V_ON and selecting each primer.

The counter selects which primers to address by enhancing the appropriate FETS. The counter is toggled by 200 uS dropouts on the single pin 5V supply, coupled to the counter through R8. Primer testing is by small negative test currents of 10 us or 30 uS duration, which produce a voltage drop across the addressed primer (the 30 uS is ignored by the counter due to the TC of R8/C5). The primer voltage drop is monitored by the fabricated instrumentation amp on the main board and sampled (P_TEST) by an A-D converter in the processor for comparison against a pre-programmed reference level window. They are required to measure 1V+/−50% for a valid result. The primer test sample period (P_TEST) should commence approximately 7 microsecond after the leading edge of the PRIMER_TEST and be no longer than necessary for a valid read. After a primer test, there must be at least 100 microsecond before any cartridge command can be executed. This is to allow full collapse of the cartridge power, so that a valid Power On reset will occur on the next power up.

Figure 17:
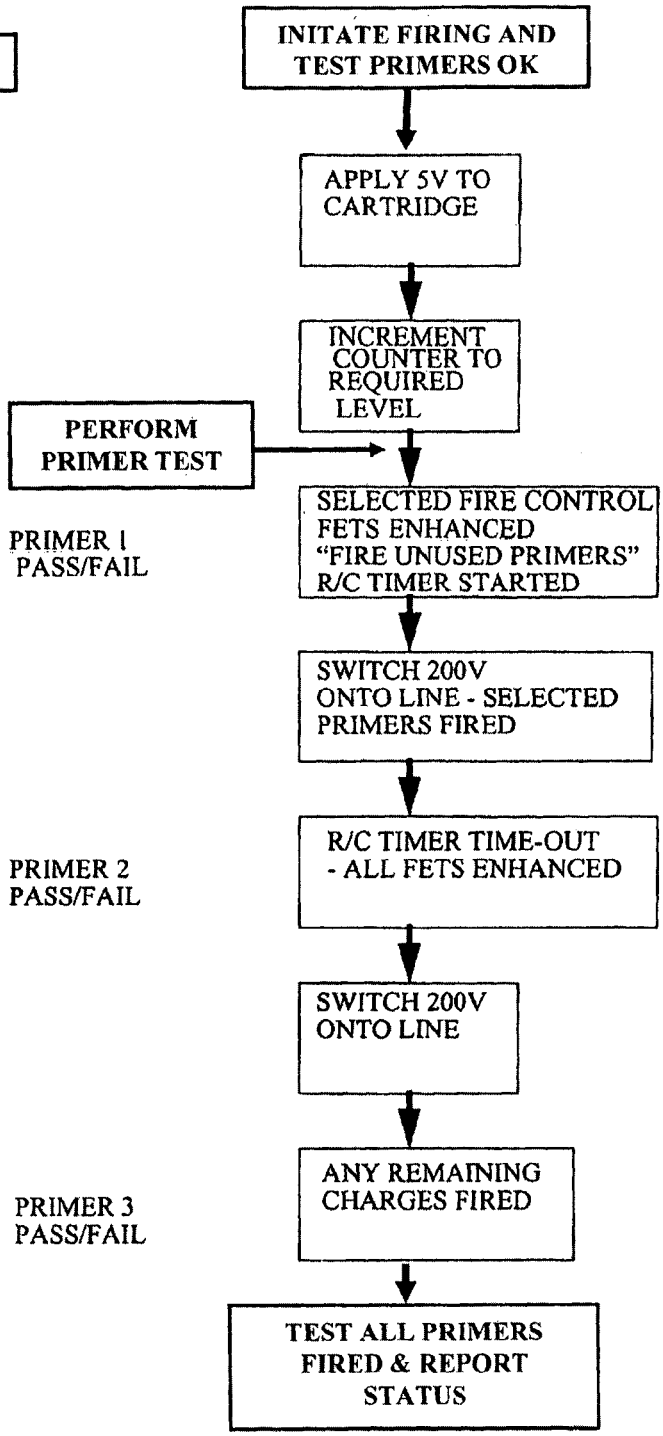
FIG. 17 is a flow chart of the firing process according to an embodiment.
Figure 19:
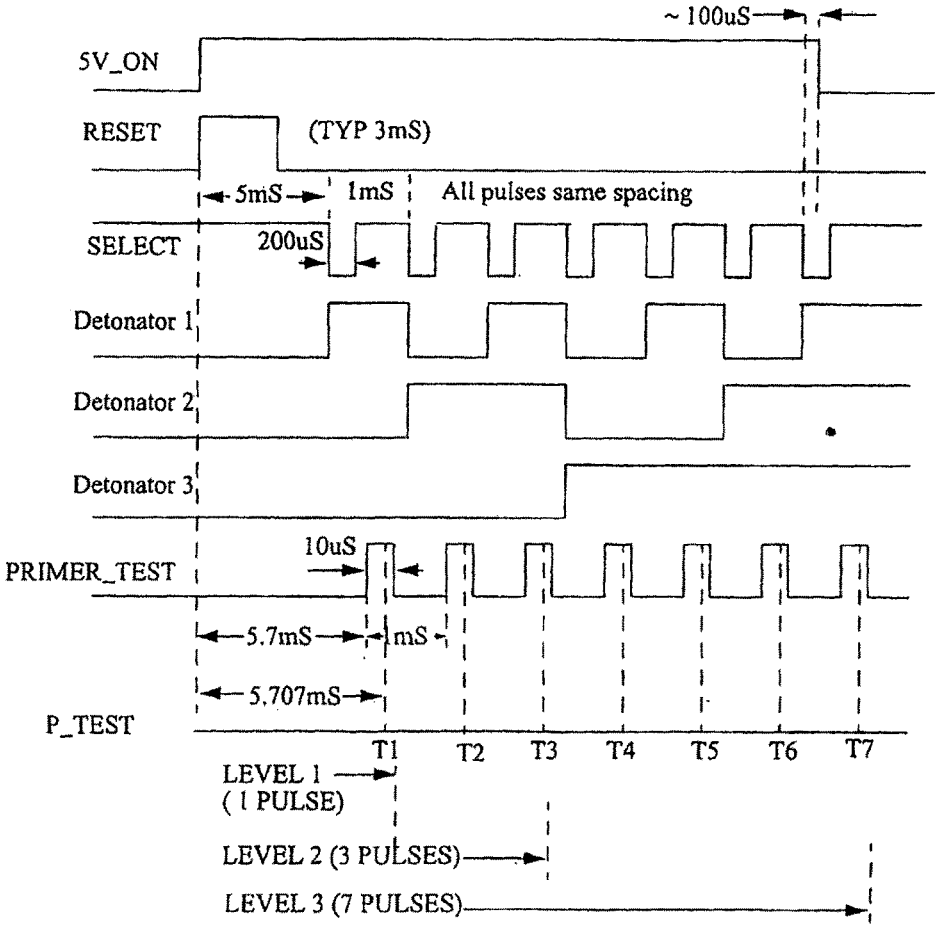
FIG. 19 is a diagram illustrating the logic signals and associated timing for selecting and testing the primers for firing in the cartridge according to an embodiment.
Figure 20:
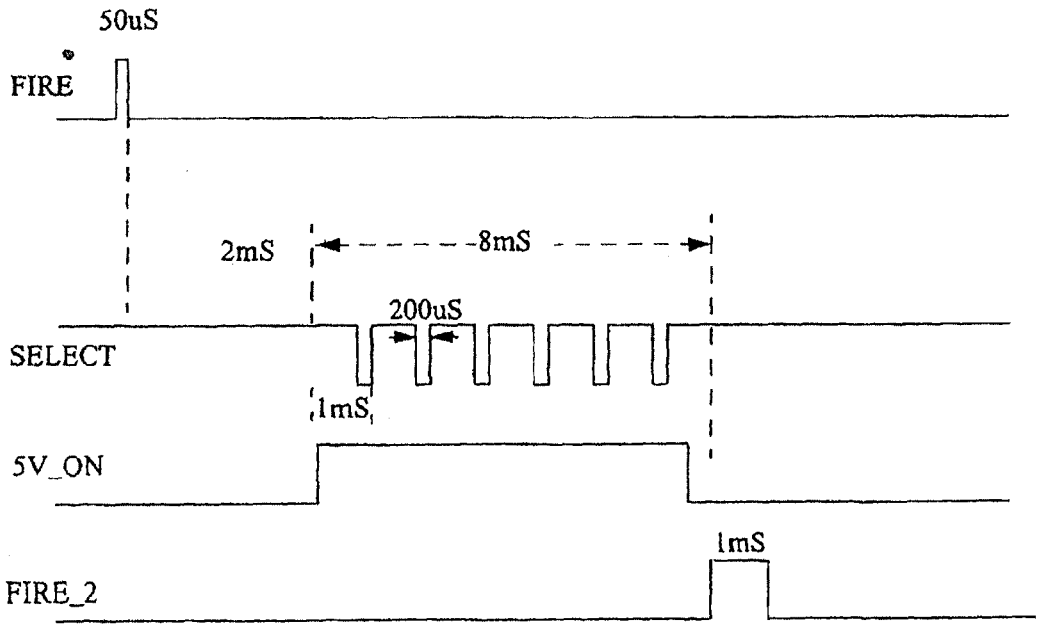
FIG. 20 is timing diagram of the process for firing the selected charges and then the remaining charges after a short delay to render the cartridge safe according to an embodiment.

A firing sequence is illustrated in FIG. 17 which occurs on operation of the firing button and is controlled by the microcontroller (PIC or similar microcontroller) FIG. 19 is a diagram illustrating the logic signals and associated timing for selecting and testing the primers for firing in the cartridge and FIG. 20 is timing diagram of the process for firing the selected charges and then the remaining charges after a short delay to render the cartridge safe. This firing sequence is initiated after the fire button is pressed, and information is available either from the laser range finder or the thumb-wheel switch on required firing level. Provided the error check is valid, firing will follow immediately. Note that the DET1, DET2, DET3 and RESET signals are generated by the cartridge function and are shown for reference only. After each select pulse, a primer test is performed and the results processed as below to confirm the correct count has occurred. 5V_ON must return low while select is low, on the last pulse of the group. Firing must follow within 5 mS of the end of the set-up sequence. The selected charges are fired first, followed by the remaining charges after a delay. During the delay enough select pulses are applied to increment the counter to its terminal count (ie all charges selected). This is illustrated in FIG. 20 in which a delay of at least 10 ms is used (30 ms typically).

With reference to FIG. 17, the 5V supply is switched onto the single pin line via R3, charging the cartridge 5V storage capacitor, C3, via its ground return, D3 and R2. Full charge will take about 10 mS. As this block of circuitry consumes virtually no power it is mostly powered by stored energy in the bypass capacitors, once these are initially charged. The single pin line is pulsed low at a low duty cycle (eg 10 uS low/1 mS high), with each pulse representing an increment in fire power levels 1 to 7. The pulses are counted by N1 (single chip CMOS such as 4024), with the active high outputs enhancing the drive FETs V3, V4, V5 via OR gates N2*a, b* & *c*. The counter increments on the rising edge of the input pulses. That is the counter selects which primers to address (ie select) by enhancing the appropriate FETS with the counter being toggled by 200 uS dropouts on the single pin 5V supply (coupled to the counter through R8). After each select pulse, a primer test is performed as part of the firing sequence. A/D converter values for voltages read at T1 to T7 are stored and the following tests are performed to confirm the correct firing level has been set. 5V_ON must return low while select is low, on the last pulse of the group. Note that only time periods within the window for the required level need to be checked. The tests are: T1=1V+/−50%; T2=1V+/−50%; T3<T1 and <T2; T4=1V+/−50%; T5<T1 and <T3; T6<T2 and <T3; and T7<T3 and <T5 and <T6. If any test fails, the firing sequence should be aborted.

Fire control FET V1 is switched on, grounding the positive end of HV storage capacitor C1, via D5, driving the single pin line 200V negative. R3 and D7 isolate the 200V drive from the 5V supply source and D4 isolates the select pulse drive logic. As the HV generator has a high output impedance it is not upset by a brief short on its output. Note that the "ground" side of the cartridge 5V supply is also translated to −200V. The 5V supply continues to power N1 and N2 from stored energy in C3. Driving the single pin line low generates an additional negative clock edge on N1 clock input, but the counter is not incremented until the single pin line returns high, so there is no corruption of the counter output. That is due to the stored energy in the cartridge circuit 5V supply system, the count status is held, and FETs enhanced by the counter outputs remain enhanced, providing a path for the firing current through the primers. As FETs V3, V4, V5 are enhanced according to the counter outputs, current will now be supplied to the primers. The FETs act as constant current sources (current level of about 700 mA) due to the constant drive voltage applied and the presence of the source resistors. Constant current drive is necessary to ensure current sharing between the primers, to protect the drive FETs if the primers short after firing (common), and to provide known firing conditions—ie specified current for a specified time. Checks have indicated that primers fire reliably with >500 mA for 10 uS.

Any unused charges in the cartridge are fired off, so that live charges do not remain in the spent casing. This can be done after several mS delay from firing the required charge as by then the projectile has left the barrel (or at least travelled sufficiently far down the barrel such that combustion of the remaining propellant does not substantially affect the exit velocity from the barrel). When the initial firing select is made with NI, C10 will commence to charge via R10 and any or all of D10, 11, 12. This will then enhance all FETs, V3, V4, V5 via the 2 inverters, which provide a clean logic transition. It can be assumed that the original 200V charge from C1 has been dissipated. V2 is now switched on by the controller, delivering a fresh 200V pulse to the single pin line from C1. As all FETs are now enhanced, any remaining charges will be fired. If all primers are seen to be open circuit, the LED flashes green indicating a fully fired, safe to discard cartridge. If any primer does not measure open circuit, the LED flashes yellow, indicating a possible hazard. The total time for the whole sequence is expected to be <30 mS. Two firing circuits are used as it is not possible to recharge a single circuit within the 30 mS time period. Note that in this embodiment no energy is stored in the cartridge—all energy/supplies are applied as part of the firing sequence (from the firing controller), and will be fully discharged in <100 mS.

In the case that a cartridge has multiple projectiles such as 3 shot shotgun cartridges 520, the primer testing will need to be modified from that described above for the standard cartridge 20 with a single projectile for firing at a range of velocities, as in this case not all of the projectiles will be required to be fired. Instead checks can be made on the specific projectiles selected to ensure they are not open circuit prior to firing, but are open circuit after firing.

A non lethal weapon system has been developed to provide a viable solution to the previously identified problems. An embodiment has been developed and will be referred to as the Managed Lethality Grenade Launcher System (MLGLS). The MLGLS system provides the user with the ability to autonomously or manually change the launch velocity of the non lethal (NL) projectile and hence optimise the impact effect on the target independent of the target's stand off range. The system can be readily adapted for use with commercial or military off the shelf (COTS/MOTS) systems with minimal changes to the weapon hardware and which does not prevent such enhanced weapons from using conventional in-service ammunition. This provides flexibility to the war fighter who can rapidly switch from non lethal to lethal ammunition in response to a change in the threat. Alternatively the system can be provided as a stand alone weapon system or platform which may be more suitable for use by civilian forces or in aid or peace keeping roles.

Figure 21:
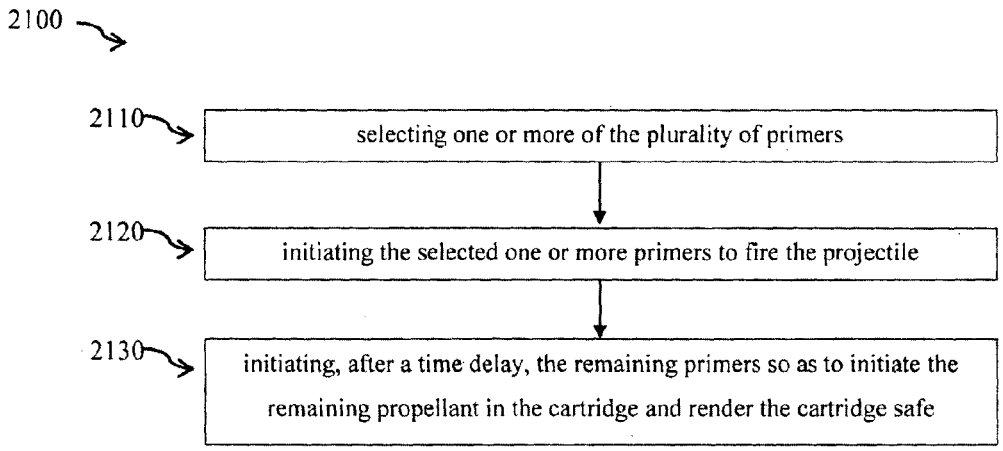
FIG. 21 is a flowchart of a method for firing a rendering safe a cartridge for firing a projectile with a selectable launch velocity according to an embodiment.

The system provides for the safe use of cartridges with a plurality of individually selectable propellant charges for firing a projectile at a selectable (or variable) launch (or exit or initial) velocity, which is particularly suitable for firing non lethal rounds. In one embodiment the cartridge comprises a plurality of primers, a plurality of propellant chambers and a projectile, wherein each primer is operatively connected to a propellant chamber to allow the projectile to be fired with a selectable launch velocity from a weapon. FIG. 21 illustrates a flowchart of a method 2100 for firing a projectile with a selectable launch velocity from a cartridge and subsequently rendering safe a cartridge according to an embodiment. The method comprises the steps of:

selecting one or more of the plurality of primers 2110;

initiating the selected one or more primers to fire the projectile 2120; and initiating, after a time delay, the remaining primers so as to initiate the remaining propellant in the cartridge and render the cartridge safe 2130.

Various other embodiments are possible. In one embodiment the cartridge includes an internal battery to provide local power for the detonation interface module, and any power required by the projectile or for initiating the charges. This would also enable the use of a wireless communication link between the weapon or fire control module and the detonation interface module. In this case a direct electrical connection is not required between the weapon module and cartridge. However this is less preferable as it may shorten the shelf life of cartridges (as this will now depend upon battery life), add extra mass, and would require additional circuitry to prevent accidental detonation of the cartridge (such as immunity to radio frequency interference) or to provide power monitoring and reporting to a user.

Similarly the range finder module could be provided with an internal battery. However in the interests of simplicity and ease of use, it is considered more convenient and beneficial to the user (particularly in military environments) to require a single battery for the entire system, along with power management and low power warning circuitry. The user can thus be notified when a new battery is required, and this can be quickly replaced to bring the system back to full functionality.

In another embodiment the battery in the fire control unit could supply current to the projectile unit. This could be used to charge circuitry (eg for taser type projectiles or fuzing) just prior to firing of the projectile, and remove the need for the projectile to include a battery.

The system has numerous advantages. A single munition can be used to deliver a range of velocities and is automatically rendered safe after use. The user can also be warned if the cartridge is not safe prior to firing, as well as after firing. A single munition can be used to deliver an on-target result which conventionally requires multiple rounds i.e. short range, medium range, long range, super long range etc. There is no requirement to change rounds depending on changing operational scenarios, which results in a faster more flexible response. The kinetic impact energy can be tailored more precisely to the engagement distance, hence less risk of unintended consequences. Propellant charges can be initiated in sequence to provide a longer impulse for accelerating the projectile. Munition trajectories are flatter hence increased delivery accuracy, which is a key requirement for any non lethal munition capability. The F88 weapon system requires minimal hardware modification and retains full conventional M203 ammunition compatibility. Unlike other systems no gas bottle or pressurised cylinder is required for power. Unlike other systems no moving parts or complicated gas venting mechanisms, hence greater reliability and lower manufacturing cost. There is no requirement for a specialised weapon as M203 can perform both lethal and non lethal functions. In summary a non lethal weapons system has been developed that is suitable for safe and effective use over a wider employment zone than current systems.

Those of skill in the art would understand that information and signals may be represented using any of a variety of technologies and techniques. For example, data, instructions, commands, information, signals, bits, symbols, and chips may be referenced throughout the above description may be represented by voltages, currents, electromagnetic waves, magnetic fields or particles, optical fields or particles, or any combination thereof.

Those of skill in the art would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The steps of a method or algorithm described in connection with the embodiments disclosed herein may be embodied directly in hardware, in a software module executed by a processor, or in a combination of the two. For a hardware implementation, processing may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof. Software modules, also known as computer programs, computer codes, or instructions, may contain a number a number of source code or object code segments or instructions, and may reside in any computer readable medium such as a RAM memory, flash memory, ROM memory, EPROM memory, registers, hard disk, a removable disk, a CD-ROM, a DVD-ROM or any other form of computer readable medium. In the alternative, the computer readable medium may be integral to the processor. The processor and the computer readable medium may reside in an ASIC or related device. The software codes may be stored in a memory unit and executed by a processor. The memory unit may be implemented within the processor or external to the processor, in which case it can be communicatively coupled to the processor via various means as is known in the art.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A fire control apparatus for selectively initiating one or more of a plurality of primers in a cartridge comprising a plurality of primers, a plurality of electrical contacts comprising a plurality of concentric annular tracks of conductive material in a rear surface of a casing, a plurality of propellant chambers and a projectile, wherein each primer is operatively connected to a propellant chamber and to one of the plurality of annular tracks to allow the projectile to be fired from the cartridge with a selectable launch velocity, the fire control apparatus comprising:

a plurality of pins for electrical connection with the plurality of electrical contacts wherein each pin is aligned with one of the plurality of concentric tracks to allow the cartridge to be loaded in any orientation;

a user interface comprising a trigger for generating a firing signal;

a firing controller in electrical communication with the cartridge, wherein the firing controller is configured to generate one or more signals in response to a firing signal to select and initiate one or more of the plurality of primers in the cartridge, and after a time delay which is sufficient to allow the projectile to be expelled from the cartridge, generates a further one or more signals to initiate the remaining primers in the cartridge so as to render the cartridge safe, and wherein the firing controller further comprises a primer testing module for sending one or more signals for testing the status of each of the plurality of primers, and the primer testing module tests the status of all of the primers after generation of the further one or more signals to initiate the remaining primers, and the user interface comprises at least one indicator for indicating a safety status of cartridge after firing of the projectile, wherein if the primer test module indicates all primers have been initiated a safe status is indicated, and if not all of the primers have been initiated, then a hazard status is indicated to alert a user that the cartridge comprises unused propellant.

2. The fire control apparatus as claimed in claim 1, wherein the user interface allows the user to select a firing mode, and the firing controller selects which of the plurality of primers to initiate from the selected firing mode.

3. The fire control apparatus as claimed in claim 1, wherein the indicator is at least one LED indicator.

4. The fire control apparatus as claimed in claim 1, wherein the user interface comprises a selector for allowing a user to manually select a fire selection mode wherein the selection of the one or more primers is determined from the fire selection mode.

5. The fire control apparatus as claimed in claim 1, further comprising a range finder for estimating the range to a target, and the firing controller selects which of the plurality of primers to be initiated in response to a firing signal using the estimated range to the target obtained from the range finder.

6. The fire control apparatus as claimed in claim 1, wherein the fire controller further comprises a memory comprising a plurality of cartridge types, and communicates with the cartridge to receive a cartridge identifier determine the type of the cartridge, and selects which of the plurality of primers in the cartridge to be initiated in response to a firing signal from the determined cartridge type.

7. The fire control apparatus as claimed in claim 1, wherein the fire control apparatus is adapted to be retrofitted to an existing weapon platform.

8. The fire control apparatus as claimed in claim 1, wherein the time delay is between 5 ms and 1 second.

9. The fire control apparatus as claimed in claim 1, wherein the time delay is at least 10 ms and 100 ms.

10. The fire control apparatus as claimed in claim 1, wherein the number of selected primers is more than one, and the selected primers are initiated in sequence, wherein each subsequent primer in the sequence is initiated a predefined primer initiation delay after initiation of the previous primer.

11. A method for firing a projectile with a selectable launch velocity from a cartridge and subsequently rendering safe the cartridge, the cartridge comprising a plurality of primers, a plurality of electrical contacts comprising a plurality of concentric annular tracks of conductive material in a rear surface of a casing, a plurality of propellant chambers and the projectile, wherein each primer is operatively connected to a respective propellant chamber and to one of the plurality of annular tracks to allow the projectile to be fired with the selected launch velocity, the method comprising:

loading the cartridge in a barrel in any orientation;

selecting one or more of the plurality of primers;

initiating the selected one or more primers to fire the projectile;

initiating, after a time delay, the remaining primers so as to initiate the remaining propellant in the cartridge and render the cartridge safe; and testing each of the primers after initiating the remaining primers to determine if each of the primers is in an open circuit state, and indicating to the user the safety status of the cartridge, wherein if all primers are in an open circuit state a safe status is indicated, otherwise an unsafe status is indicated.

12. The method as claimed in claim 11, wherein the time delay is determined so that the launch velocity of the projectile is unaffected by initiation of the remaining propellant charges.

13. The method as claimed in claim 11, wherein the time delay is between 5 ms and 1 second.

14. The method as claimed in claim 11, wherein the time delay is between 10 ms and 100 ms.

15. A weapon system for firing a projectile with a selectable launch velocity, the weapon comprising:

a barrel for receiving a cartridge loaded in any orientation, the cartridge comprising:

a casing;

a plurality of propellant chambers located within the casing;

a plurality of primers, each primer operatively connected with one of the plurality of propellant chambers for initiating the propellant in the respective chamber;

a plurality of electrical contacts comprising a plurality of concentric annular tracks of conductive material in a rear surface of the casing wherein each of the plurality of annular tracks is connected to one of the plurality of primers;

a projectile located in a forward end of the casing;

a cavity formed between the forward end of each of the plurality of propellant chambers and the rear of the projectile to receive the propellant gases from one or more of the plurality of propellant chambers to fire the projectile from the casing; and a primer interface module located in a rear end of the casing for selectively initiating one or more of the plurality of primers to fire the projectile from the casing, and wherein in use, after firing the projectile from the casing, the remaining primers are initiated after a delay to initiate the remaining propellant in the cartridge and render the cartridge safe, and a firing control apparatus comprising:

a plurality of pins for electrical connection with the plurality of electrical contacts wherein each pin is aligned with one of the plurality of concentric tracks to allow the cartridge to be loaded in any orientation;

a user interface comprising a trigger for generating a firing signal; and a firing controller in electrical communication with the cartridge, wherein the firing controller is configured to generate one or more signals in response to a firing signal to select and initiate one or more of the plurality of primers in the cartridge, and after a time delay which is sufficient to allow the projectile to be expelled from the cartridge, generates a further one or more signals to initiate the remaining primers in the cartridge so as to render the cartridge safe; and wherein the firing controller further comprises a primer testing module for sending one or more signals for testing the status of each of the plurality of primers, and the primer testing module tests the status of all of the primers after generation of the further one or more signals to initiate the remaining primers, and the user interface comprises at least one indicator for indicating a safety status of cartridge after firing of the projectile, wherein if the primer test module indicates all primers have been initiated a safe status is indicated, and if not all of the primers have been initiated, then a hazard status is indicated to alert a user that the cartridge comprises unused propellant.

16. The weapon system as claimed in claim 15, wherein the forward end of each of the propellant chambers further comprises a selectively rupturable seal for sealing the end of the respective propellant chamber from the cavity, wherein if primer is selectively initiated and initiates propellant in the associated chamber, the associated seal ruptures to release propellant gas into the cavity, and a primer is not selectively initiated, the associated seal is resistant to rupturing due to the presence of propellant gas in the cavity from propellant chambers which were selectively initiated.

17. The weapon system as claimed in claim 15, wherein the primer interface module comprises a cartridge identifier to allow the firing controller to determine the type of the cartridge.

* * * * *